US010399340B2

(12) United States Patent
Saiba et al.

(10) Patent No.: US 10,399,340 B2
(45) Date of Patent: Sep. 3, 2019

(54) NOZZLE PLATE, LIQUID EJECTING HEAD, LIQUID EJECTING APPARATUS, AND METHOD OF MANUFACTURING NOZZLE PLATE

(71) Applicant: SEIKO EPSON CORPORATION, Tokyo (JP)

(72) Inventors: Takashi Saiba, Shiojiri (JP); Yasutaka Matsumoto, Suwa (JP); Takuya Miyakawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/987,615

(22) Filed: May 23, 2018

(65) Prior Publication Data

US 2018/0339517 A1 Nov. 29, 2018

(30) Foreign Application Priority Data

May 26, 2017 (JP) ..... 2017-104230
Jul. 31, 2017 (JP) ..... 2017-147581

(51) Int. Cl.
*B41J 2/16* (2006.01)
*B41J 2/14* (2006.01)

(52) U.S. Cl.
CPC ..... *B41J 2/162* (2013.01); *B41J 2/1433* (2013.01); *B41J 2/14233* (2013.01); *B41J 2/164* (2013.01); *B41J 2/1606* (2013.01); *B41J 2/1623* (2013.01); *B41J 2/1626* (2013.01); *B41J 2/1632* (2013.01); *B41J 2/1645* (2013.01); *B41J 2/1646* (2013.01); *B41J 2002/14241* (2013.01)

(58) Field of Classification Search
CPC ..... B41J 2/162; B41J 2/1626; B41J 2/1646; B41J 2/1645; B41J 2/1632; B41J 2/1606; B41J 2/1623; B41J 2/14233; B41J 2/1433; B41J 2/164; B41J 2002/14241
See application file for complete search history.

(56) References Cited

U.S. PATENT DOCUMENTS 5,502,470 A * 3/1996 Miyashita ..... B41J 2/1606 347/45
6,186,616 B1 * 2/2001 Inoue ..... B41J 2/14016 347/45
6,821,330 B1 * 11/2004 Sano ..... C09D 11/54 106/31.49
7,837,300 B2 * 11/2010 Mori ..... B41J 2/1433 347/45
8,128,204 B2 * 3/2012 Ozaki ..... B41J 2/14129 216/27

(Continued)

FOREIGN PATENT DOCUMENTS

JP 07-052395 A 2/1995
JP 2005-103793 A 4/2005

(Continued)

OTHER PUBLICATIONS

IP.com search (Year: 2019).*

*Primary Examiner* — Lisa Solomon
(74) *Attorney, Agent, or Firm* — Workman Nydegger

(57) ABSTRACT

A nozzle plate includes a nozzle from which a liquid is ejected and that has an opening at one surface side of the nozzle plate and a liquid repelling layer containing a cross-linked fluororesin and formed on the one surface side of the nozzle plate.

20 Claims, 24 Drawing Sheets

(56) References Cited

U.S. PATENT DOCUMENTS

2002/0007765 A1* 1/2002 Sano ..... C09D 11/322 106/31.49
2004/0125169 A1* 7/2004 Nakagawa ..... B05D 5/083 347/45
2004/0223033 A1* 11/2004 Sasaki ..... B41J 2/1606 347/45
2005/0068368 A1 3/2005 Ishizuka et al.
2005/0088485 A1* 4/2005 Tamahashi ..... B41J 2/1433 347/45
2006/0154035 A1* 7/2006 Iwata ..... B41M 7/00 428/209
2008/0170101 A1* 7/2008 Kwon ..... B41J 2/1603 347/45
2010/0209611 A1* 8/2010 Ohshima ..... B41J 2/1606 427/256
2010/0214354 A1* 8/2010 Ohshiba ..... B41J 2/1606 347/22
2012/0074434 A1* 3/2012 Park ..... H01L 33/486 257/88
2012/0098896 A1 4/2012 Nihei
2014/0055527 A1* 2/2014 Hashimoto ..... B41J 2/1433 347/45
2014/0183284 A1* 7/2014 Nagatoya ..... B41J 2/14233 239/548
2017/0043580 A1* 2/2017 Takagi ..... B41J 2/14274
2017/0057227 A1* 3/2017 Ozawa ..... B41J 2/1433
2017/0341396 A1* 11/2017 Ozawa ..... B41J 2/035

FOREIGN PATENT DOCUMENTS

JP 2007-213715 A 8/2007
JP 2012-91380 A 5/2012
JP 2013-27875 A 2/2013
JP 2013-209670 A 10/2013
JP 2014-124874 A 7/2014

* cited by examiner

NOZZLE PLATE, LIQUID EJECTING HEAD, LIQUID EJECTING APPARATUS, AND METHOD OF MANUFACTURING NOZZLE PLATE

BACKGROUND

1. Technical Field

The present invention relates to a nozzle plate the surface of which has been subjected to a liquid repelling treatment, a liquid ejecting head, a liquid ejecting apparatus, and a method of manufacturing the nozzle plate.

2. Related Art

A liquid ejecting apparatus is an apparatus that includes a liquid ejecting head and that ejects various types of liquid from nozzles that open in a nozzle plate of the liquid ejecting head. As liquid ejecting apparatuses, for example, there exist image recording devices such as ink jet printers, ink jet plotters and the like, however, recently, liquid ejecting apparatuses have been applied to various manufacturing devices by utilizing their advantage of being capable of making a minute amount of liquid precisely land onto a designated position. For example, liquid ejecting apparatuses have been applied to display manufacturing devices that manufacture color filters of liquid crystal displays and the like, electrode forming devices that form electrodes of organic electroluminescence (EL) displays, field emission displays (FEDs) and the like, and chip manufacturing devices that manufacture biochips. In addition, a recording head for image recording devices ejects liquid ink, and a color material ejecting head for display manufacturing devices ejects solutions of individual color materials of red (R), green (G), and blue (B). Moreover, an electrode material ejecting head for electrode forming devices ejects a liquid electrode material and a bioorganic matter ejecting head for chip manufacturing devices ejects a solution of bioorganic matter.

In such a liquid ejecting apparatus, a portion of the droplets ejected from the nozzles sometimes adheres to the surface of the nozzle plate (more specifically, the surface from which the droplets are ejected). In particular, when liquid adheres to the vicinity of the nozzles, there is a possibility that problems such as bending of the droplet flight direction may occur due to interference with liquid droplets ejected from the nozzles. In order to suppress such a problem, a liquid ejecting head in which a liquid repelling film is formed on the surface of a nozzle plate has been disclosed (refer to JP-A-2014-124874).

In a wiping operation for wiping the surface of the nozzle plate with a wiper or the like, the liquid repelling film on the surface of the nozzle plate may be scraped. In particular, in the case where an ink containing a pigment such as titanium oxide as a liquid to be ejected is used, the pigment contained in the ink acts like an abrasive, and wear of the liquid repelling film due to the wiping operation becomes marked. As a result, sufficient liquid repellency may not be obtained on the surface of the nozzle plate.

SUMMARY

An advantage of some aspects of the invention is that a nozzle plate in which deterioration of a liquid repelling layer formed on a surface thereof is suppressed, a liquid ejecting head, a liquid ejecting apparatus, and a method of manufacturing the nozzle plate are provided.

A nozzle plate according to an aspect of the invention is a nozzle plate includes a nozzle from which liquid is ejected and that has an opening at one surface side of the nozzle plate, and a liquid repelling layer containing a cross-linked fluororesin and formed on the one surface side of the nozzle plate.

According to this configuration, because a liquid repelling layer containing a fluororesin is formed, liquid repellency can be imparted to one surface side of the nozzle plate. In addition, because the liquid repelling layer contains a cross-linked fluororesin, abrasion resistance can be improved as compared with a fluororesin that is not cross-linked. As a result, deterioration of the liquid repellency on one surface side of the nozzle plate can be suppressed.

In the above configuration, it is preferable that the liquid repelling layer be cross-linked with the one surface side.

According to this configuration, it is possible to improve the adhesiveness (adhesion) of the liquid repelling layer to the nozzle plate. As a result, separation of the liquid repelling layer can be suppressed.

In addition, in any of the above-described configurations, it is preferable that the nozzle plate further include a protective layer that is formed on the one surface side and that protects against liquid, and the liquid repelling layer be stacked on the protective layer.

According to this configuration, even if a defect such as a pinhole or a crack occurs in a portion of the liquid repelling layer, it is possible to protect one surface side of the nozzle plate by the protective layer.

Furthermore, in the above configuration, it is preferable that the protective layer have conductivity.

According to this configuration, it is possible to reduce the amount of charge on the one surface side of the nozzle plate.

In addition, in any one of the above configurations, it is preferable that the nozzle have a first portion including the opening and a second portion communicating with the first portion, that the diameter of the opening of the first portion be larger than the diameter of the second portion, and that the liquid repelling layer be formed on the first portion.

According to this configuration, abrasion of the liquid repelling layer at the edge of the opening of the nozzle can be suppressed.

Furthermore, in the above structure, it is preferable that the first portion be formed in a shape in which an edge corner of the opening is cut out.

Alternatively, it is preferable that the first portion be formed in a shape in which an edge corner of the opening is chamfered diagonally.

Alternatively, it is preferable that the first portion be formed in a shape in which an edge corner of the opening is rounded.

According to these configurations, processing of the first portion of the nozzle plate is facilitated.

In addition, a liquid ejecting head of the invention is characterized in that it includes any one of the above-described nozzle plates.

According to this configuration, the reliability of the liquid ejecting head can be improved.

Furthermore, a liquid ejecting apparatus of the invention is characterized in that it includes the liquid ejecting head having the above configuration.

According to this configuration, the reliability of the liquid ejecting apparatus can be improved.

A method of manufacturing a nozzle plate according to an aspect of the invention is a method of manufacturing a nozzle plate in which a liquid repelling layer containing a cross-linked fluororesin is formed on one surface side where a nozzle from which a liquid is ejected opens, the method including stacking a non-cross-linked-fluororesin-containing layer in which a non-cross-linked-fluororesin-containing layer, which contains a non-cross-linked fluororesin prior to cross-linking, is stacked on the one surface side, and cross-linking the non-cross-linked-fluororesin-containing layer prior to cross-linking in order to form the liquid repelling layer by irradiating the non-cross-linked-fluororesin-containing layer with heat in a low oxygen atmosphere having an oxygen concentration not higher than a predetermined value.

According to this method, it is possible to form a liquid repelling layer having improved abrasion resistance on one surface side of the nozzle plate. Consequently, it is possible to manufacture a nozzle plate in which deterioration of the liquid repelling layer is suppressed.

In the above method, it is preferable to perform removal in which at least a portion of the liquid repelling layer formed in the nozzle is removed.

According to this method, because of the liquid repelling layer, the nozzle can be prevented from being blocked.

In addition, in the above-described method, in the removal, it is preferable to remove at least a portion of the liquid repelling layer formed in the nozzle by performing irradiation with an ion beam or radiation from the one surface side in a state where a mask having a through hole formed at a position corresponding to the nozzle is superimposed on the liquid repelling layer from the one surface side.

According to this method, the liquid repelling layer in the nozzle can be easily removed.

In addition, in the above method, in the removal, it is preferable to remove at least a portion of the liquid repelling layer formed in the nozzle by performing irradiation with an ion beam or radiation from the side opposite to the one surface side.

According to this method, the liquid repelling layer in the nozzle can be removed more easily.

Furthermore, in any one of the above methods, it is preferable to include polishing in which the surface of the liquid repelling layer is polished after the cross-linking.

According to this method, even if the surface of the liquid repelling layer is damaged by irradiation of radiation, the damaged portion can be removed.

In addition, in any one of the above methods, it is preferable that the stacking of the non-cross-linked-fluororesin-containing layer include dispersion coating in which a dispersion, which contains particles of the non-cross-linked fluororesin and a dispersion medium in which the particles of the non-cross-linked fluororesin are dispersed, is applied on the one surface side and drying in which the dispersion medium is evaporated from the dispersion applied on the one surface side.

According to this method, a smooth non-cross-linked-fluororesin-containing layer having few defects such as pinholes and cracks can be produced. This makes it possible to manufacture a smooth liquid repelling layer with fewer defects.

Furthermore, in the above method, it is preferable that the average particle diameter of the non-cross-linked fluororesin contained in the dispersion be not more than half of the film thickness of the liquid repelling layer formed on the one surface side.

According to this method, unevenness of the surface due to particles of the non-cross-linked fluororesin can be suppressed, and a smoother liquid repelling layer can be produced.

Alternatively, in any one of the above methods, it is preferable that the stacking of the non-cross-linked-fluororesin-containing layer include sheet arranging in which a resin sheet containing the non-cross-linked fluororesin is brought into close contact with the one surface.

According to this method, the non-cross-linked-fluororesin-containing layer can be easily stacked on one surface side.

Furthermore, in the cross-linking step of any one of the above methods, it is preferable to cross-link the non-cross-linked fluororesin while suction is performed through the nozzle.

According to this method, the liquid repelling layer can be formed inside the nozzle.

In addition, in any of the above methods, it is preferable that the non-cross-linked-fluororesin-containing layer stacking and the cross-linking be alternately repeated at least two or more times.

According to this method, even in the case where the liquid repelling layer is thick, variation in the thickness of the liquid repelling layer can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, modes for carrying out the invention will be described with reference to the accompanying drawings. Further, the embodiment described below is a preferred embodiment of the invention, and even though various limitations are imposed, the scope of the invention is not intended to be limited to these limitations unless there is a particular description that limits the invention in the following description. In addition, in the following description, an ink jet type recording head (hereinafter referred to as a recording head 3) mounted in an ink jet type printer (hereinafter referred to as a printer 1) which is one type of liquid ejecting apparatus is described as an example of a liquid ejecting head.

Figure 1:
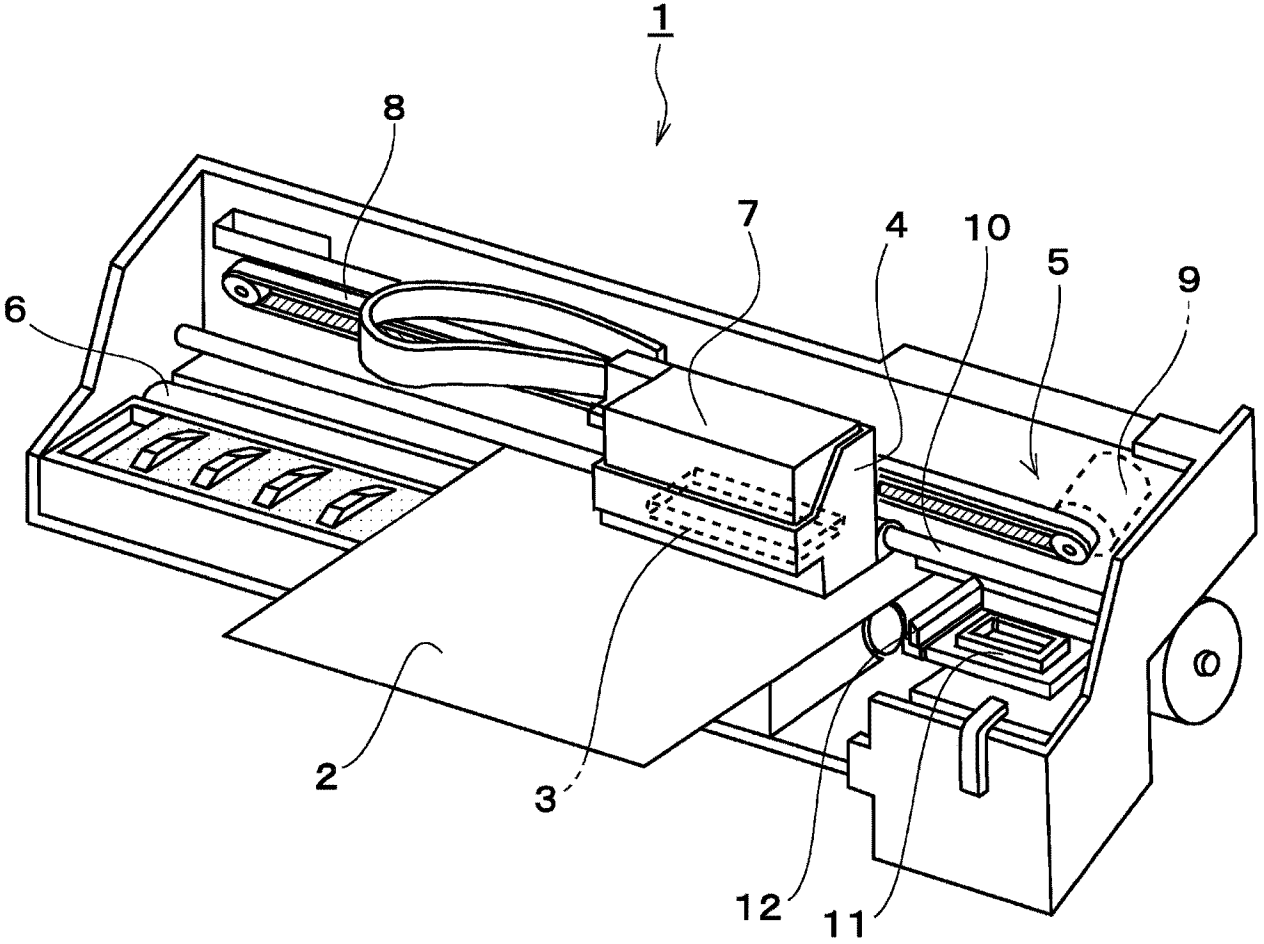
FIG. 1 is a perspective diagram illustrating a configuration of a printer.

FIG. 1 is a perspective view of the printer 1. The printer 1 is an apparatus that ejects ink (a type of liquid) onto the surface of a recording medium 2 (a type of landing target) such as recording paper to record images and the like. The printer 1 includes the recording head 3, a carriage 4 on which the recording head 3 is mounted, a carriage moving mechanism 5 that moves the carriage 4 in a main scanning direction, a transport mechanism 6 that transports the recording medium 2 in a sub-scanning direction, and the like. Here, the ink is stored in an ink cartridge 7 that functions as a liquid supply source. The ink cartridge 7 is detachably attached to the recording head 3. Further, the ink cartridge is arranged in the body of the printer, and has a structure that enables the recording head to be supplied with ink from the ink cartridge by an ink supply tube.

The carriage moving mechanism 5 has a timing belt 8. The timing belt 8 is driven by a pulse motor 9 such as a DC motor. Therefore, when the pulse motor 9 operates, the carriage 4 is guided by a guide rod 10 that is installed in the printer 1 and reciprocates in the main scanning direction (the width direction of the recording medium 2). The position of the carriage 4 in the main scanning direction is detected by a linear encoder (not illustrated), which is a type of positional information detection device. The linear encoder transmits a detection signal, that is, an encoder pulse (a type of positional information) to a control unit of the printer 1.

A home position, which is a standby position of the recording head 3, is set at a position deviated to one end side (right side in FIG. 1) in the main scanning direction with respect to the area (or printing area) where the recording medium 2 is transported. At this home position, a cap 11 and a wiper 12 are provided. The cap 11 is a member made of, for example, an elastic material for sealing a nozzle surface 23 (described later) of the recording head 3 waiting at the home position. In addition, the wiper 12 is a member that wipes the nozzle surface 23 of the recording head 3 that waits at the home position. The wiper 12 in this embodiment is formed of an elastic body such as an elastomer and is formed in a blade shape. Further, as the wiper 12, a sheet-shaped member made of cloth such as cotton or silk can be used. In addition, the wiper 12 in this embodiment is configured to wipe the nozzle surface 23 along a nozzle row direction, which is an arrangement direction of nozzles 22.

Figure 2:
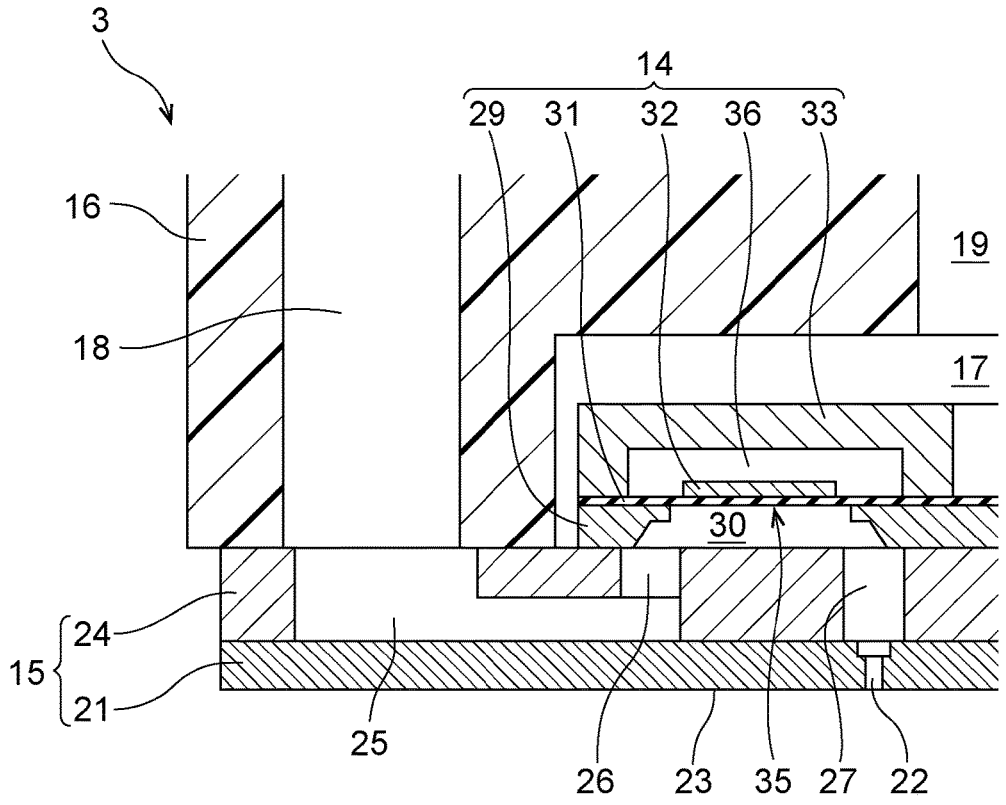
FIG. 2 is a cross-sectional diagram illustrating a configuration of a recording head.
Figure 3:
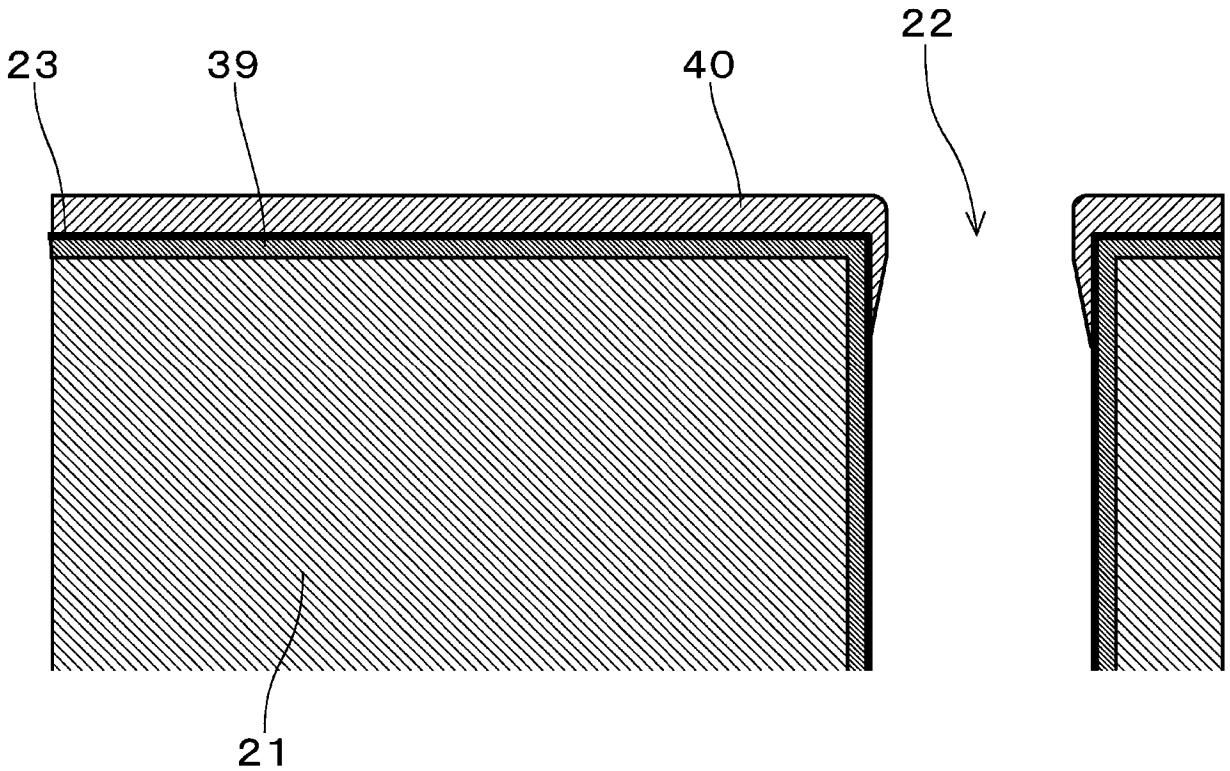
FIG. 3 is an enlarged schematic cross-sectional view of a nozzle plate.

Next, the recording head 3 will be described. FIG. 2 is a cross-sectional view of the main part of the recording head 3 for explaining the configuration of the recording head 3. FIG. 3 is an enlarged schematic cross-sectional view of a nozzle plate 21. Further, because the configuration of the recording head 3 is generally symmetrical in a direction orthogonal to the nozzle row direction, only one configuration is illustrated in FIG. 2. In addition, in FIG. 3, contrary to FIG. 2, the nozzle surface 23 is illustrated as being upward. Furthermore, in the following description, for the sake of convenience, description will be made assuming that a head case 16 side is upward (or upper side) and the nozzle surface 23 side is downward (or lower side). As illustrated in FIG. 2, the recording head 3 of this embodiment is attached to the head case 16 in which an actuator unit 14 and a flow channel unit 15 are stacked.

The head case 16 is a box-like member formed of a synthetic resin, and a liquid introduction channel 18 for supplying ink to each of pressure chambers 30 is formed inside the head case 16. The liquid introduction channel 18, together with common liquid chambers 25 described later, is a space in which ink shared by a plurality of the pressure chambers 30 is stored. In this embodiment, two of the liquid introduction channels 18 are formed corresponding to two rows of the pressure chambers 30. In addition, in a portion of the head case 16 on the lower side (the side of the flow channel unit 15), a accommodating space 17, which has a hollow box shape, is formed from the lower surface (the surface on the flow channel unit 15 side) of the head case 16 up to the middle of the head case 16 in the height direction. When the flow channel unit 15 is joined to the lower surface of the head case 16 while being positioned on the lower surface of the head case 16, the actuator unit 14 stacked on a communication substrate 24 (described later) is formed so as to be accommodated in the accommodating space 17. Furthermore, on a portion of the ceiling surface of the accommodating space 17, there is formed an insertion opening 19 that enables the space outside the head case 16 and the accommodating space 17 to communicate with each other. A wiring board such as a flexible printed circuit (FPC) (not illustrated) is inserted through the insertion opening 19 into the accommodating space 17 and connected to the actuator unit 14 in the accommodating space 17.

The flow channel unit 15 in this embodiment has the communication substrate 24 and the nozzle plate 21. The nozzle plate 21 is a silicon substrate (for example, a single-crystal silicon substrate) that is joined to the lower surface (the surface on the opposite side to a pressure chamber forming substrate 29) of the communication substrate 24. In this embodiment, the opening on the lower surface side of the space forming each of the common liquid chambers 25 is sealed by the nozzle plate 21. In addition, a plurality of the nozzles 22 are linearly arranged (in rows) in the nozzle plate 21. Two rows of the nozzles 22 (that is, nozzle rows) formed of the plurality of the nozzles 22 are formed in the nozzle plate 21. The nozzles 22 constituting each nozzle row are provided at a pitch corresponding to the dot formation density from the nozzle 22 on one end side to the nozzle 22 on the other end side, for example, at equal intervals along the main scanning direction. Further, it is possible to join a nozzle plate to a communication substrate at regions away from the interior of common liquid chambers and seal the openings on the lower surface side of the common liquid chambers by using a member such as a compliance sheet that, for example, has flexibility. In addition, in the following description, the outer surface of the nozzle plate 21 (the lower surface in FIG. 2, corresponding to one surface in the invention) where the nozzle 22 opens is referred to as the nozzle surface 23.

As illustrated in FIG. 3, for example, a protective layer 39 formed of a thermal oxide film ($SiO_2$) and a tantalum oxide film ($TaO_x$) stacked thereon, a tantalum nitride film (TaN) or the like is formed on the surface of the nozzle plate 21 of this embodiment. The protective layer 39 has ink resistance and is a layer for protecting the surface of the nozzle plate 21. In addition, as the protective layer 39, a material having conductivity such as a tantalum nitride film (TaN) is preferable. In this way, by using a material having conductivity for the protective layer 39, for example, if the protective layer 39 is electrically connected to a fixing plate (a plate for fixing the recording head 3) (not illustrated), an earth wire, or the like, even when a liquid repelling layer 40 containing a fluororesin is formed, charging of the nozzle surface 23 can be suppressed, as will be described later. In other words, the amount of charge on the nozzle surface 23 side of the nozzle plate 21 can be reduced. Further, note that the protective layer 39 may have a single layer structure composed of one layer or a multilayer structure in which a plurality of layers are stacked on one another. When the protective layer 39 is constituted by a plurality of layers, it may be configured so that the outermost layer has ink resistance. In addition, the protective layer 39 is formed on the surface on the opposite side to the inner surface of the nozzle 22 and the nozzle surface 23.

The liquid repelling layer 40 is stacked on the surface of the protective layer 39 of the nozzle surface 23. In this embodiment, the liquid repelling layer 40 is formed on the entire surface of the nozzle surface 23. The liquid repelling layer 40 is a layer containing a cross-linked fluororesin and has liquid repellency. That is, the liquid repelling layer 40 has a contact angle of 90° or more with respect to the ink. In addition, the liquid repelling layer 40 is also cross-linked with the nozzle surface 23 (more specifically, the protective layer 39 of the nozzle surface 23) and bonded to the nozzle surface 23. Further, the liquid repelling layer 40 is not necessarily formed on the entire surface of the nozzle surface 23 and it may be formed over at least the region of the nozzle surface 23 where the nozzle 22 is formed. In addition, in this embodiment, as illustrated in FIG. 3, the liquid repelling layer 40 is also formed in the vicinity of the opening on the inner circumferential surface of the nozzle 22 on the nozzle surface 23 side. Consequently, the meniscus of the ink in the nozzle 22 is formed in a region where the protective layer 39 is exposed which is far from the region where the liquid repelling layer 40 is formed.

Here, as the fluororesin having liquid repellency, for example, polytetrafluoroethylene (PTFE), a tetrafluoroethylene-perfluoroalkyl vinyl ether copolymer (PFA), a tetrafluoroethylene-hexafluoropropylene copolymer (FEP), or a combination thereof may be used. In addition, as the fluororesin, it is preferable that a fluororesin that has no polymerizable group be used. As described above, by using a fluororesin having no polymerizable group, it is possible to suppress binding of unnecessary substances as a result of a polymerization reaction and to suppress a decrease in liquid repellency. Furthermore, the thickness (film thickness) of the liquid repelling layer 40 is desirably 1 μm or more and 70 μm or less. By setting the film thickness in this manner, sufficient durability can be obtained. Further, the method of forming the liquid repelling layer 40 will be described later in detail.

As illustrated in FIG. 2, the communication substrate 24 is a silicon substrate constituting the upper portion (the portion on the head case 16 side) of the flow channel unit 15. In the communication substrate 24, the common liquid chambers 25 that communicate with the liquid introduction channels 18 and that store ink common to the pressure chambers 30, and individual ones of communication channels 26 that individually supply ink from the liquid introduction channels 18 along the common liquid chambers 25 to the pressure chambers 30 respectively, and nozzle communication channels 27 with which the pressure chambers 30 and the nozzles 22 communicate with each other are formed by anisotropic etching. The common liquid chambers 25 are elongated hollow portions along the nozzle row direction, and are formed in two rows corresponding to the rows of the pressure chambers 30 arranged in two rows. In addition, a plurality of individual ones of the communication channels 26 and a plurality of the nozzle communication channels 27 are formed along the nozzle row direction.

As illustrated in FIG. 2, the actuator unit 14 in this embodiment is a unit in which the pressure chamber forming substrate 29, a diaphragm 31, a piezoelectric element 32, which is one type of actuator, and a sealing plate 33 are stacked on one another and is joined to the communication substrate 24. Further, the actuator unit 14 is formed to be smaller than the accommodating space 17 so as to be accommodated in the accommodating space 17.

The pressure chamber forming substrate 29 is a silicon substrate (for example, a single-crystal silicon substrate) constituting a lower portion (a portion on the flow channel unit 15 side) of the actuator unit 14. A portion of the pressure chamber forming substrate 29 is removed in the plate thickness direction by anisotropic etching, so as to form a plurality of spaces, which are to become the pressure chambers 30, parallelly arranged along the nozzle row direction. These spaces are partitioned from below by the communication substrate 24 and from above by the diaphragm 31 so as to form the pressure chambers 30. In addition, these spaces, namely, the pressure chambers 30, are formed in two rows corresponding to the two nozzle rows. Each of the pressure chambers 30 is a long space that extends in a direction diagonal to the nozzle row direction, one end of which in the longitudinal direction communicates with a corresponding one of the communication channels 26 and the other end of which communicates with a corresponding one of the nozzle communication channels 27.

Further, the diaphragm 31, for example, may be formed of an elastic film composed of silicon dioxide ($SiO_2$) formed on the upper surface of the pressure chamber forming substrate 29 and an insulating film composed of zirconium oxide ($ZrO_2$) formed on the elastic film. A region corresponding to each of the pressure chambers 30 in the diaphragm 31 is a drive region 35 in which flexural deformation is permitted and the piezoelectric element 32 is stacked thereon. The piezoelectric elements 32 of this embodiment are so-called bend mode piezoelectric elements. In each of the piezoelectric elements 32, for example, a lower electrode layer, a piezoelectric layer, and an upper electrode layer are sequentially stacked on the diaphragm 31. One of the upper electrode layer and the lower electrode layer is a common electrode formed commonly for the piezoelectric elements 32 and the other is an individual electrode individually formed for each of the piezoelectric elements 32. When an electric field corresponding to the potential difference between the lower electrode layer and the upper electrode layer is applied between the lower electrode layer and the upper electrode layer, the piezoelectric element 32 bends and deforms in a direction away from or toward the nozzle 22. Consequently, the volume of the pressure chamber 30 changes, causing pressure fluctuation in the ink in the pressure chamber 30. By utilizing this pressure fluctuation, the ink in the pressure chamber 30 can be ejected from the nozzle 22. Further, the piezoelectric elements 32 of this embodiment each correspond to one of the pressure chambers 30 parallelly arranged in two rows along the nozzle row direction and are formed in two rows along the nozzle row direction.

As illustrated in FIG. 2, the sealing plate 33 is a substrate formed of single-crystal silicon, metal, synthetic resin or the like bonded to the upper surface of the pressure chamber forming substrate 29 (more specifically, the upper surface of the diaphragm 31). A piezoelectric element accommodating space 36 recessed from the lower surface of the sealing plate 33 to a point midway in the plate thickness direction of the sealing plate 33 is formed on the lower surface of the sealing plate 33. A row of the piezoelectric elements 32 is accommodated in the piezoelectric element accommodating space 36. In this embodiment, the piezoelectric element accommodating space 36 is formed in two rows that correspond to the two rows of the piezoelectric elements 32. Further, an opening that penetrates the sealing plate 33 in the plate thickness direction is formed in a portion between the two of the piezoelectric element accommodating spaces 36. In this opening, a terminal of a wiring board inserted through the insertion opening 19 and a terminal of wiring extending from the piezoelectric element 32 are connected to each other.

Figure 4:
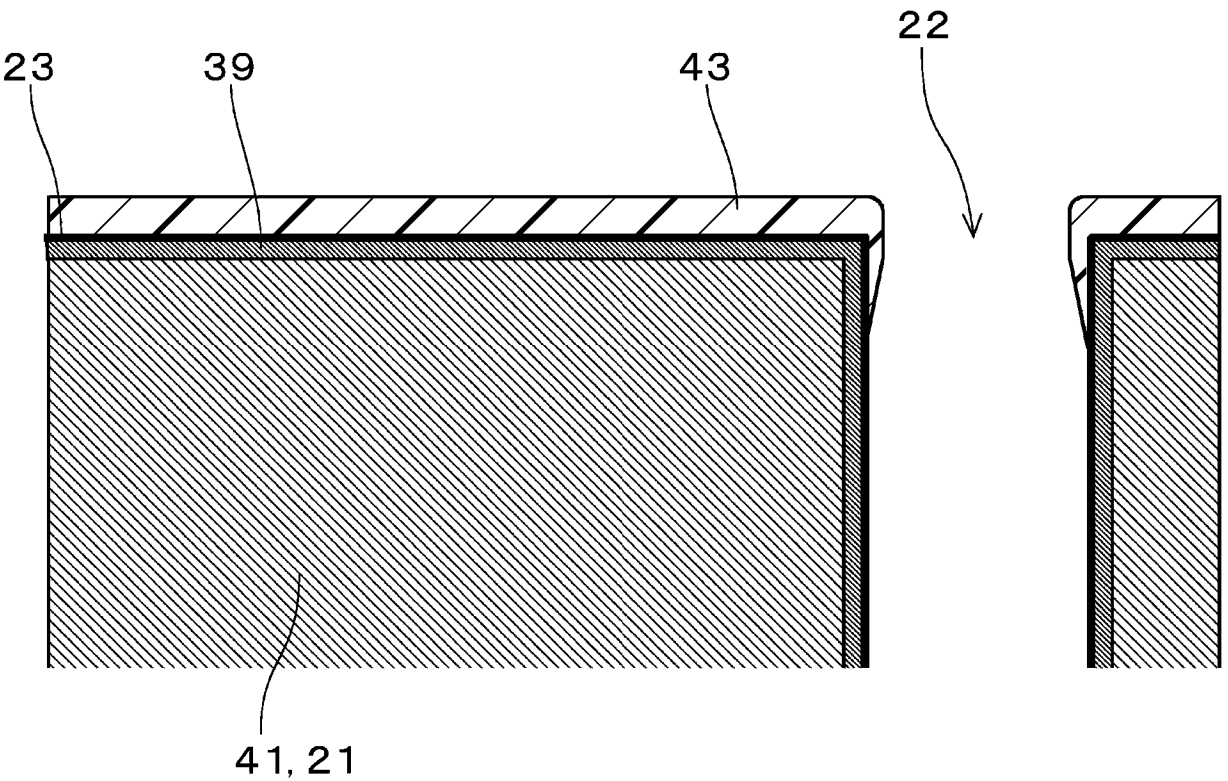
FIG. 4 is a state transition diagram of a cross section for explaining a method of manufacturing the nozzle plate.
Figure 5:
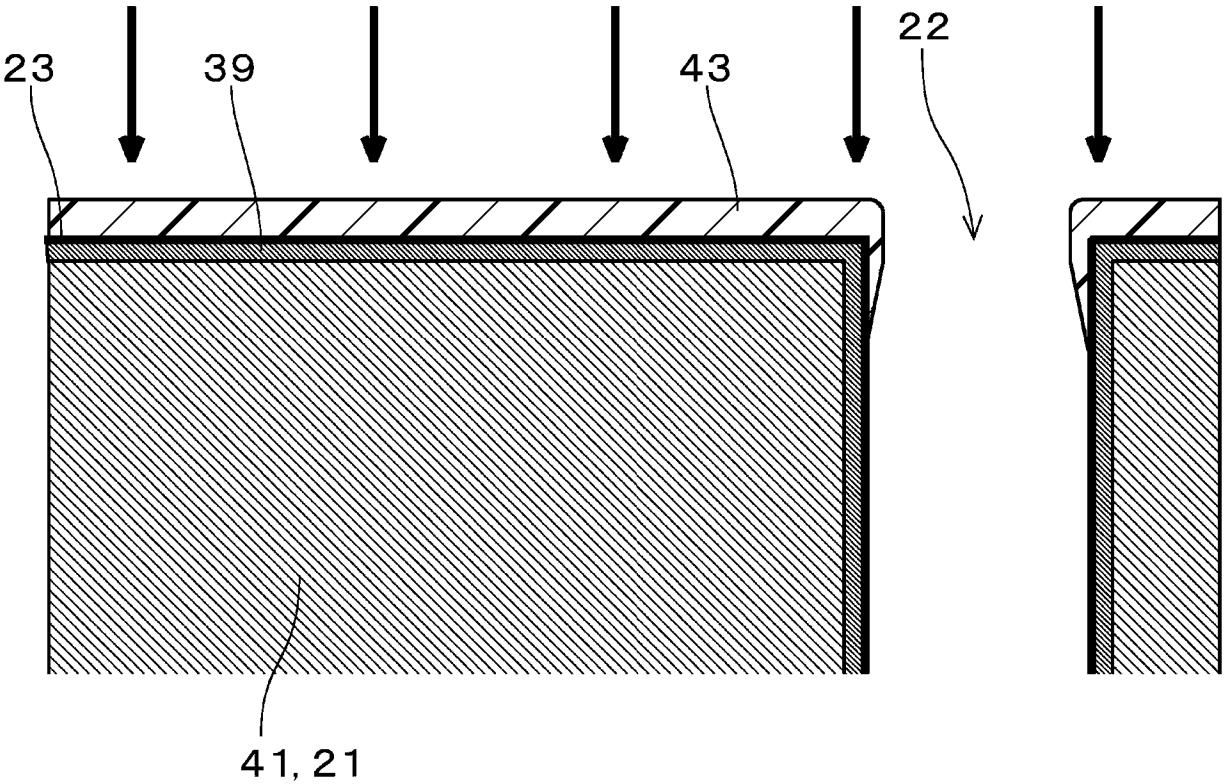
FIG. 5 is a state transition diagram of a cross section for explaining the method of manufacturing the nozzle plate.
Figure 6:
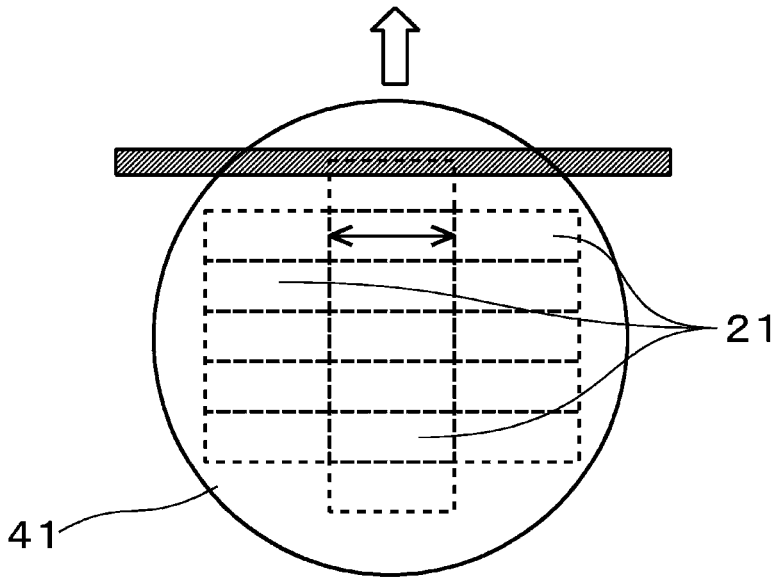
FIG. 6 is a schematic view for explaining irradiation of radiation during cross-linking.

Next, a method of manufacturing the recording head 3, particularly, a method of manufacturing the nozzle plate 21 will be described in detail. Further, in this embodiment, a method of forming the liquid repelling layer 40 on a substrate (for example, a silicon wafer) to be the nozzle plate 21 and then dividing it into individual ones of the nozzle plates 21 is exemplified. FIG. 4 and FIG. 5 are state transition diagrams of the cross section of the nozzle plate 21 (the substrate 41), showing the manufacturing process of the nozzle plate 21. In addition, FIG. 6 is a schematic view for explaining irradiation of radiation in the cross-linking.

First, the nozzles 22 are formed at predetermined positions in the substrate 41 which will be the nozzle plate 21. The nozzles 22 are formed so as to penetrate the nozzle plate 21 by, for example, a laser or Bosch method. Next, the protective layer 39 is formed on the surface of the substrate 41. After forming a thermal oxide film ($SiO_2$) on the surface of the nozzle plate 21 by thermal oxidation, the protective layer 39 is, for example, formed by forming a layer such as a tantalum oxide film ($TaO_x$) by a sputtering method, an atomic layer deposition (ALD) method, a chemical vapor deposition method, a vacuum evaporation method, or the like.

After forming the protective layer 39 on the nozzle plate 21, as illustrated in FIG. 4, in non-cross-linked-fluororesin-containing layer stacking, a non-cross-linked-fluororesin-containing layer 43 containing a non-cross-linked fluororesin prior to cross-linking is formed (stacked) on the nozzle surface 23 side. Specifically, dispersion coating in which a dispersion in which non-cross-linked-fluororesin particles having no polymerizable group are colloidally dispersed in a dispersion medium (a liquid in which particles of a non-cross-linked fluororesin are dispersed, in this embodiment, an aqueous liquid) (for example, PTFE dispersion, PFA dispersion, FEP dispersion, or the like) is formed (coated) on the nozzle surface 23 and drying of the dispersion formed on the nozzle surface 23 (that is, evaporating the dispersion medium from the dispersion) are performed. As a result, as illustrated in FIG. 4, the non-cross-linked-fluororesin-containing layer 43 composed of non-cross-linked fluororesin is formed on the nozzle surface 23. Further, as a method for uniformly coating the dispersion on the nozzle surface 23 in the dispersion coating, for example, spray coating in which the nozzle surface 23 is coated by spraying the dispersion in a mist form by an atomization type spray, spin coating in which a dispersion is supplied onto the nozzle surface 23 and the substrate 41 is rotated at a high speed to thereby form a dispersion in a thin film state by centrifugal force, and dip coating in which the substrate 41 is immersed in a dispersion liquid can be adopted. In this case, because the dispersion medium is removed in the drying, it is preferable to apply the dispersion thicker than the target thickness of the liquid repelling layer 40. In addition, the average particle diameter of the non-cross-linked fluororesin particles contained in the dispersion is desirably not more than half of the target thickness of the liquid repelling layer 40. In this way, it is possible to suppress formation of irregularities due to non-cross-linked-fluororesin particles on the surface of the non-cross-linked-fluororesin-containing layer 43. As a result, the liquid repelling layer 40 that is smoother can be produced. In this embodiment, a dispersion containing non-cross-linked-fluororesin particles having an average particle size of 0.15 μm to 0.35 μm is used.

After forming the non-cross-linked-fluororesin-containing layer 43 on the nozzle surface 23 side, the cross-linking of the non-cross-linked-fluororesin-containing layer 43 to form the liquid repelling layer 40 is performed. In this cross-linking, the non-cross-linked-fluororesin-containing layer 43 is heated in a low oxygen atmosphere in which the oxygen concentration is a predetermined value or less (for example, oxygen concentration is 1000 ppm or less). For example, in the case where the non-cross-linked-fluororesin-containing layer 43 is formed of PTFE, it is heated to 327° C. or higher, which is its melting point. In addition, in the case where the non-cross-linked-fluororesin-containing layer 43 is formed of PFA, it is heated to 310° C. or more, which is its melting point. Furthermore, in the case where the non-cross-linked-fluororesin-containing layer 43 is formed of FEP, it is heated to 275° C. or higher, which is its melting point. As illustrated in FIG. 5 and FIG. 6, in this state (that is, in a state in which the substrate 41 is heated in a low oxygen atmosphere), radiation having an irradiation dose of, for example, 50 kGy to 300 kGy is irradiated to the non-cross-linked-fluororesin-containing layer 43. Consequently, the non-cross-linked-fluororesin-containing layer 43 is cross-linked to form the liquid repelling layer 40. Further, arrows in FIG. 5 represent irradiation images of radiation. As the radiation, α ray, β ray, γ ray, X ray, electron beam or the like can be used.

Here, a radiation irradiation method will be described with reference to FIG. 6. Further, the hatched portion in FIG. 6 indicates the irradiation region of the radiation, and the area indicated by the broken line indicates the area to be the nozzle plates 21. The radiation irradiation region in this embodiment is set to be a long line in a direction substantially orthogonal to the relative movement direction of the substrate 41 (refer to white arrow in FIG. 6). In addition, the substrate 41 is arranged such that the longitudinal direction of the radiation irradiation region and the direction of the nozzle row, that is, the wiping direction of the wiper 12 (the direction of the arrow in FIG. 6) are aligned. Then, while irradiating the radiation, the substrate 41 is relatively moved with respect to the radiation. As a result, the whole surface of the substrate 41 is irradiated with radiation, and the non-cross-linked-fluororesin-containing layer 43 on the entire surface of the substrate 41 is cross-linked. As a result, as illustrated in FIG. 3, the liquid repelling layer 40 containing the fluorine resin cross-linked to the nozzle surface 23 is formed. That is, the liquid repelling layer 40 having improved wear resistance is formed on the nozzle surface 23 of the nozzle plate 21. In addition, the protective layer 39 of the nozzle surface 23 and the liquid repelling layer 40 undergo a cross-linking reaction, and the liquid repelling layer 40 is firmly bonded to the nozzle surface 23. Further, at the same time, because the cross-linking reaction proceeds in the region irradiated with radiation, the bond tends to be firm. Therefore, as in this embodiment, it is possible to improve the wear resistance of the liquid repelling layer 40 in the wiping direction by aligning the longitudinal direction of the radiation irradiation region with the wiping direction of the wiper 12. As a result, the durability of the nozzle plate 21 with respect to the wiping operation can be further improved. This further improves the reliability of the printer 1.

The irradiation region of radiation is not limited to the region exemplified above. For example, it is possible to set the irradiation region of the radiation so that the whole of the substrate 41 is therein and cross-link the non-cross-linked-fluororesin-containing layer 43 in a region to be all the nozzle plates 21 by irradiation with a single radiation without moving the substrate 41. In addition, by setting the irradiation region of the radiation so that it coincides with the area to be one or a plurality of the nozzle plates 21, relatively moving the irradiation region, and irradiating the radiation plural times, the non-cross-linked-fluororesin-containing layer 43 in the region to be all the nozzle plates 21 may be cross-linked. Furthermore, by irradiating the periphery of the nozzles 22 in each nozzle plate 21 while relatively moving the substrate 41 using radiation irradiated in a point shape, only the non-cross-linked-fluororesin-containing layer 43 formed around the nozzles 22 can also be cross-linked.

Figure 7:
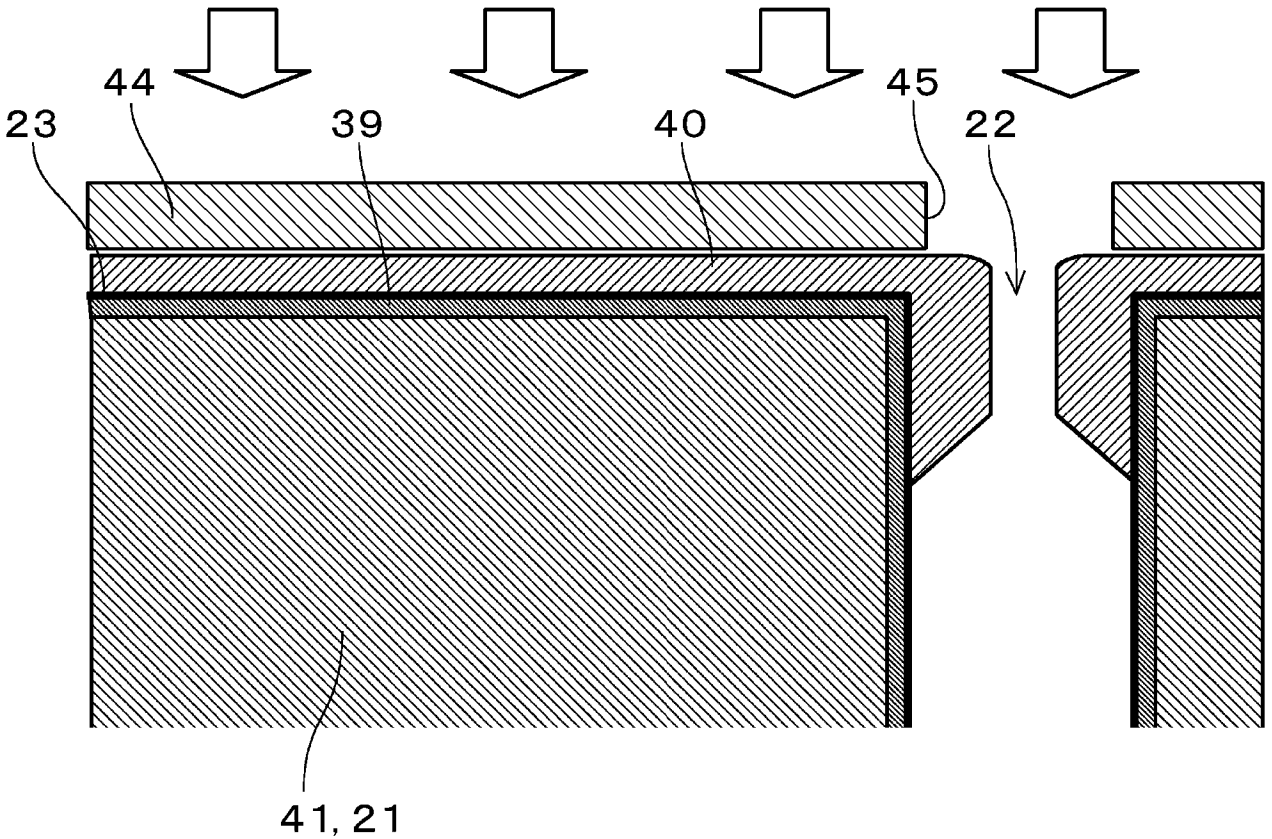
FIG. 7 is a schematic view of a cross section of the nozzle plate for explaining removal.
Figure 8:
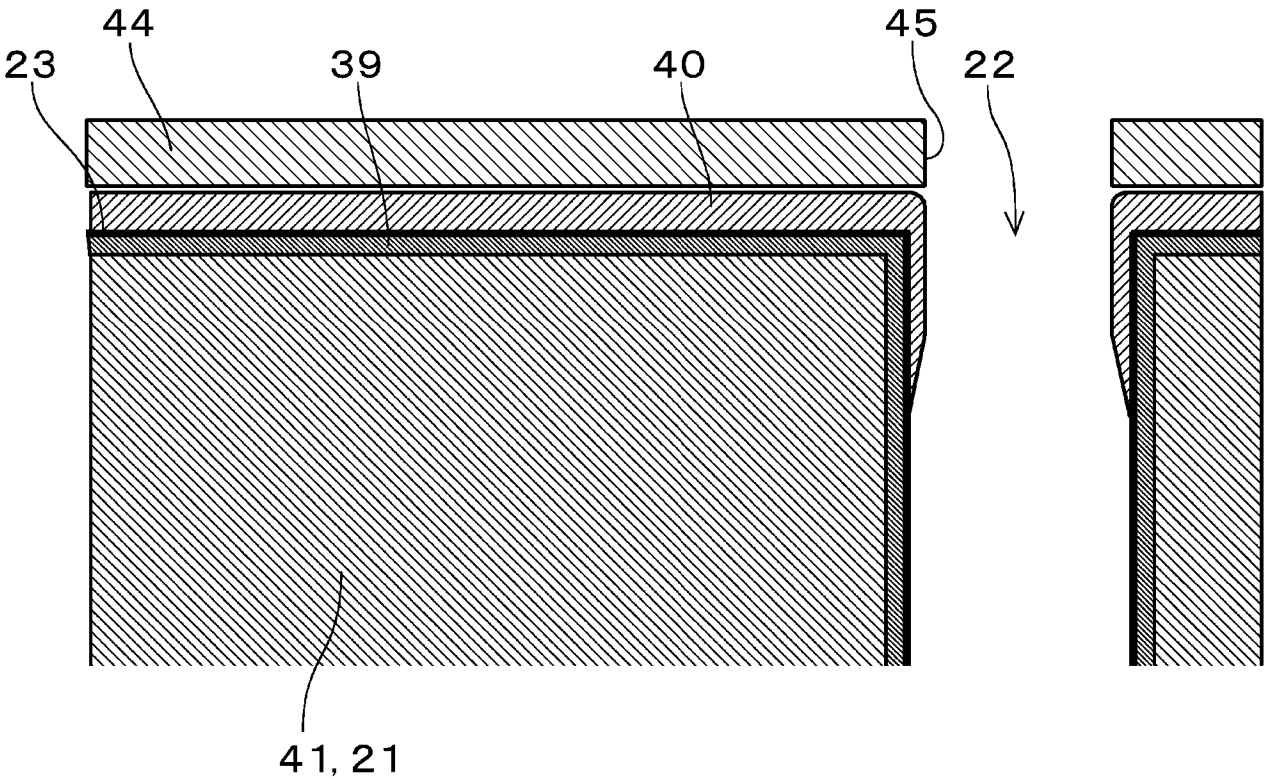
FIG. 8 is a schematic view of a cross section of the nozzle plate for explaining removal.

In the case where the thickness of the liquid repelling layer 40 is relatively thick, the diameter of the nozzle 22 is relatively small, or in the case where the viscosity of the dispersion is low, the area of the opening of the nozzle 22 is narrowed by the liquid repelling layer 40 which has entered the nozzle 22, and there is a possibility that the ink cannot be ejected normally. In addition, the entire opening of the nozzle 22 may be blocked by the liquid repelling layer 40. Therefore, after the cross-linking, it is preferable to remove at least a portion of the liquid repelling layer 40 formed in the nozzle 22. As a method of removing the liquid repelling layer 40 formed in the nozzles 22, for example, in a state where a mask 44 having through holes 45 formed at positions corresponding to the nozzles 22 is superimposed on the liquid repelling layer 40 from the nozzle surface 23 side, there is a method of removing at least a portion of the liquid repelling layer 40 formed in the nozzles 22 by irradiation with an ion beam or radiation from the nozzle surface 23 side. FIG. 7 is a schematic view for explaining the removal of the liquid repelling layer 40 using an ion beam. Further, it should be noted that the hollow arrows in FIG. 7 illustrate an image of ion beam irradiation. The mask 44 is a plate-like member formed of a material that is not broken by an ion beam, such as molybdenum or tungsten. In the mask 44, as illustrated in FIG. 7, the through hole 45 is formed at a position corresponding to the nozzle 22. Further, the diameter of the through hole 45 in this embodiment is formed to be slightly smaller than the diameter of the nozzle 22. In the removal, the mask 44 is positioned on the liquid repelling layer 40 so that the center of the nozzle 22 and the center of the through hole 45 are aligned with each other and aligned with respect to the substrate 41. In this state, the ion beam is irradiated from above the mask (the side opposite to the substrate 41). As a result, it is possible to easily remove the portion not covered by the mask 44, that is, the portion of the liquid repelling layer 40 exposed through the through hole 45. As a result, as illustrated in FIG. 8, a portion of the liquid repelling layer 40 in the nozzle 22 is removed, and the opening of the nozzle 22 is expanded. Therefore, defective ejection of ink caused by the blocking of a portion or the whole of the nozzle 22 with the liquid repelling layer 40 can be suppressed. In this embodiment, even though the liquid repelling layer 40 is left slightly in the vicinity of the opening on the inner surface of the nozzle 22 on the side of the nozzle surface 23, by adjusting the size of the through hole 45 of the mask 44, it is also possible to remove the entirety of the liquid repelling layer 40 in the nozzle 22.

After the liquid repelling layer 40 is formed on the substrate 41 by the above method, it is divided into individual ones of the nozzle plates 21 by a cutter or the like. Thereby, the nozzle plates 21 having the liquid repelling layer 40 formed on the nozzle surface 23 are manufactured. Thereafter, the nozzle plates 21 that have been divided are adhered to the lower surface of the communication substrate 24 and the actuator unit 14 is bonded to the upper surface of the communication substrate 24. Then, by attaching the head case 16 to the communication substrate 24 so that the actuator unit 14 is accommodated in the accommodating space 17, the recording head 3 is formed.

As described above, because the liquid repelling layer 40 containing fluororesin is formed on the nozzle surface 23 side of the nozzle plate 21 in the invention, it is possible to impart liquid repellency to the nozzle surface 23 side of the nozzle plate 21. In addition, because the liquid repelling layer 40 contains a cross-linked fluororesin, abrasion resistance can be improved as compared with a fluororesin not cross-linked. As a result, deterioration of liquid repellency on the nozzle surface 23 of the nozzle plate 21 can be suppressed. As a result, the durability of the nozzle plate 21 with respect to the wiping operation by the wiper 12 is improved, which in turn improves the reliability of the recording head 3 and the printer 1. In addition, because the liquid repelling layer 40 is bonded to the nozzle surface 23 by being cross-linked with the nozzle surface 23, it is possible to improve the adhesiveness (adhesion) of the liquid repelling layer 40 to the nozzle plate 21. As a result, separation of the liquid repelling layer 40 from the nozzle surface 23 can be suppressed. Furthermore, because a method of forming the dispersion on the nozzle surface 23 is employed in manufacturing the nozzle plate 21 (specifically, the non-cross-linked-fluororesin-containing layer stacking), the non-cross-linked-fluororesin-containing layer 43 with smoothness and with few defects such as pinholes and cracks can be produced. As a result, the liquid repelling layer 40 that is smooth and that has few defects can be produced. Even if defects such as pinholes and cracks are generated in a portion of the liquid repelling layer 40, because the nozzle surface 23 is covered with the protective layer 39, the nozzle surface 23 of the nozzle plate 21 can be protected by the protective layer 39.

Figure 9:
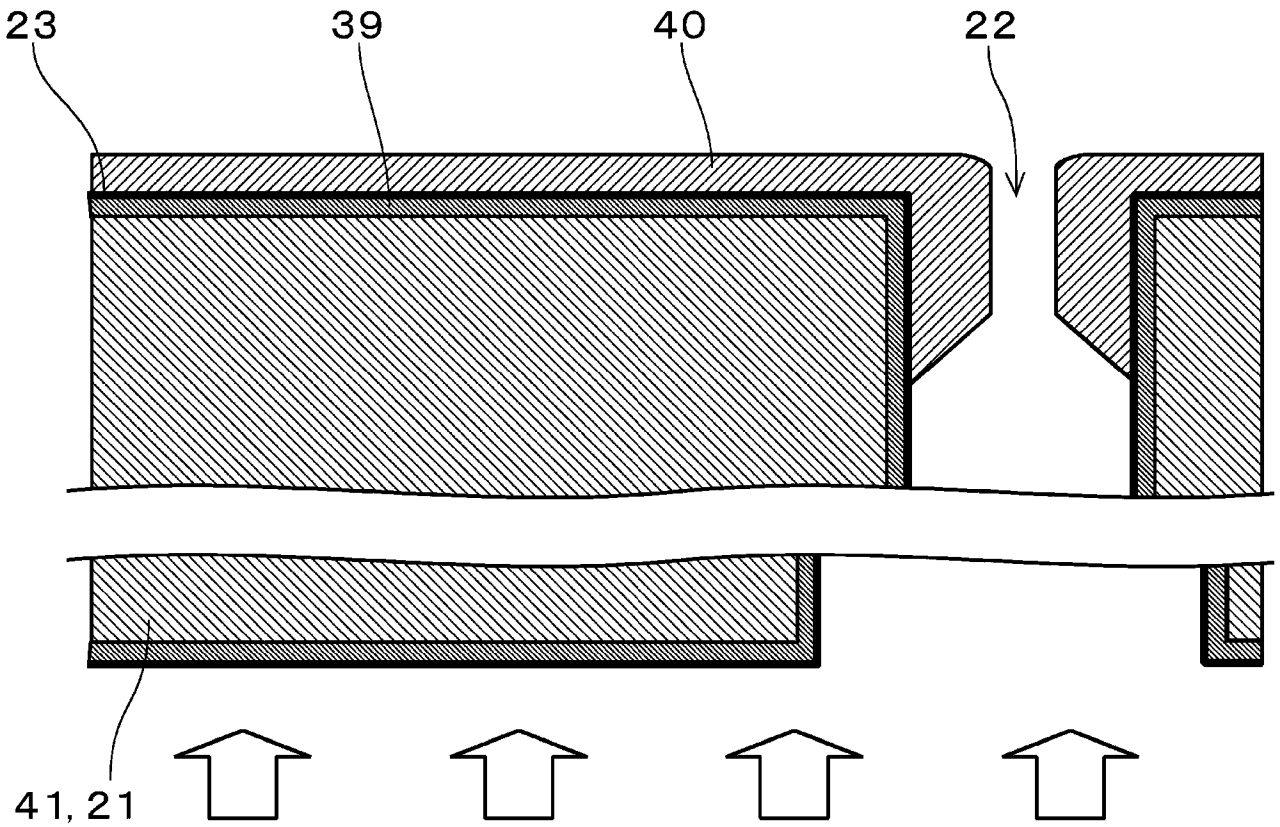
FIG. 9 is a schematic view of a cross section of the nozzle plate for explaining a modification example of removal.
Figure 10:
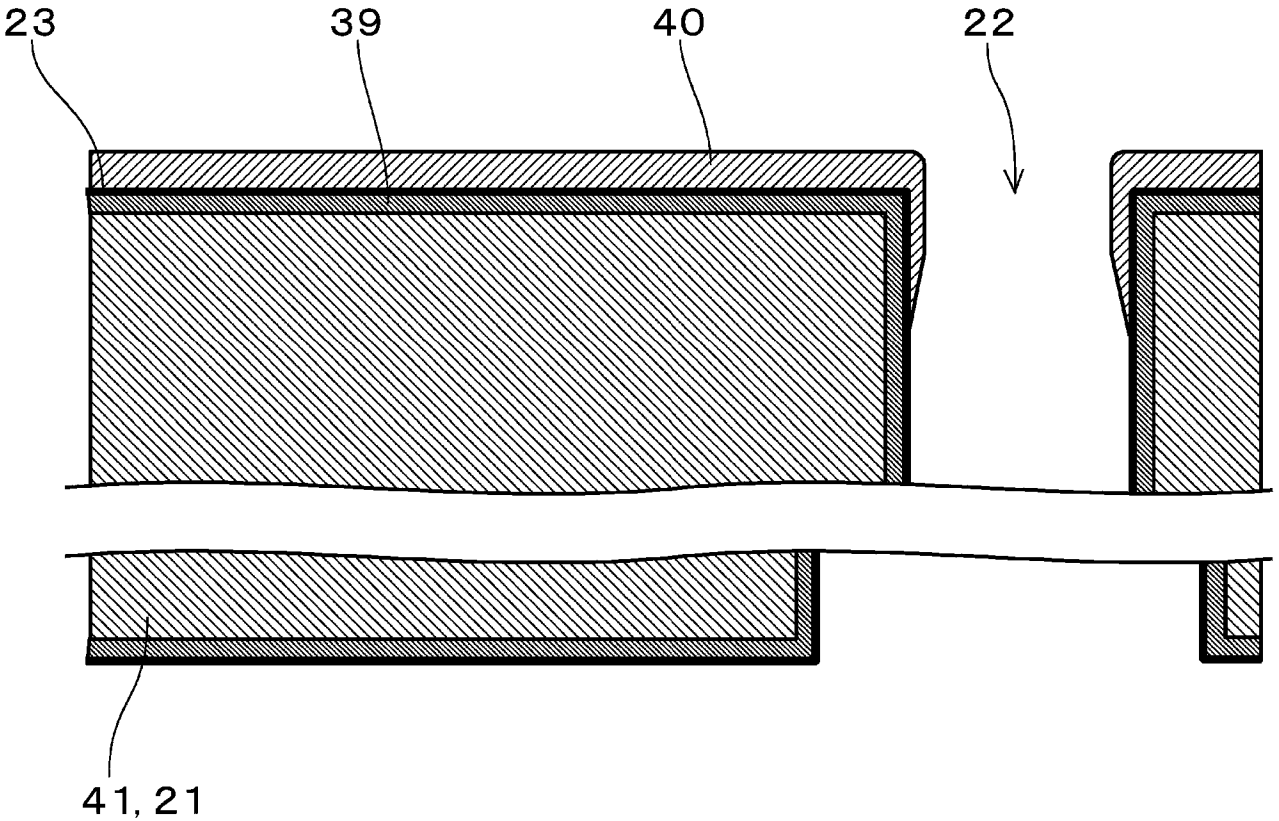
FIG. 10 is a schematic view of a cross section of the nozzle plate for explaining a modification example of removal.

The method of manufacturing the nozzle plate 21 is not limited to the above-described first embodiment. For example, FIG. 9 and FIG. 10 illustrate a modification example of the removal. In the removal in this modification example, as illustrated in FIG. 9, an ion beam is irradiated from the side opposite to the nozzle surface 23. As a result, because the ion beam does not strike the nozzle surface 23, the liquid repelling layer 40 on the nozzle surface 23 is not removed, whereas, because the ion beam strikes the liquid repelling layer 40 in the nozzle 22 as illustrated in FIG. 10, at least a portion of the liquid repelling layer 40 formed in the nozzle 22 is removed. Consequently, the opening of the nozzle 22 is widened, and defective ejection of ink due to blockage of the nozzle 22 by the liquid repelling layer 40 can be suppressed. Further, by adjusting the intensity of the ion beam, irradiation time, and the like, it is possible to adjust the amount of the liquid repelling layer 40 remaining in the nozzle 22. In this embodiment, as illustrated in FIG. 10, the liquid repelling layer 40 is formed to remain slightly in the vicinity of the opening on the inner surface of the nozzle 22 on the side of the nozzle surface 23; however, the liquid repelling layer 40 in the nozzle 22 can be completely removed.

Figure 11:
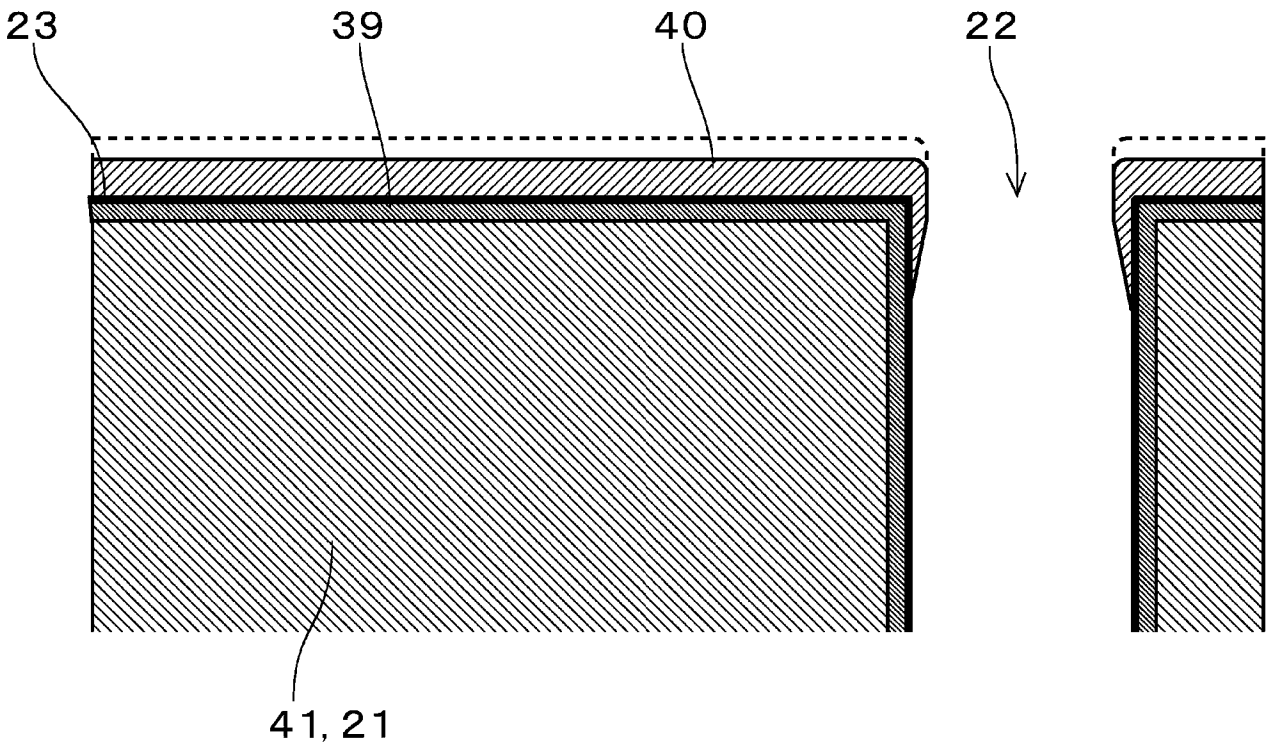
FIG. 11 is a schematic view of a cross section of the nozzle plate for explaining polishing.
Figure 12:
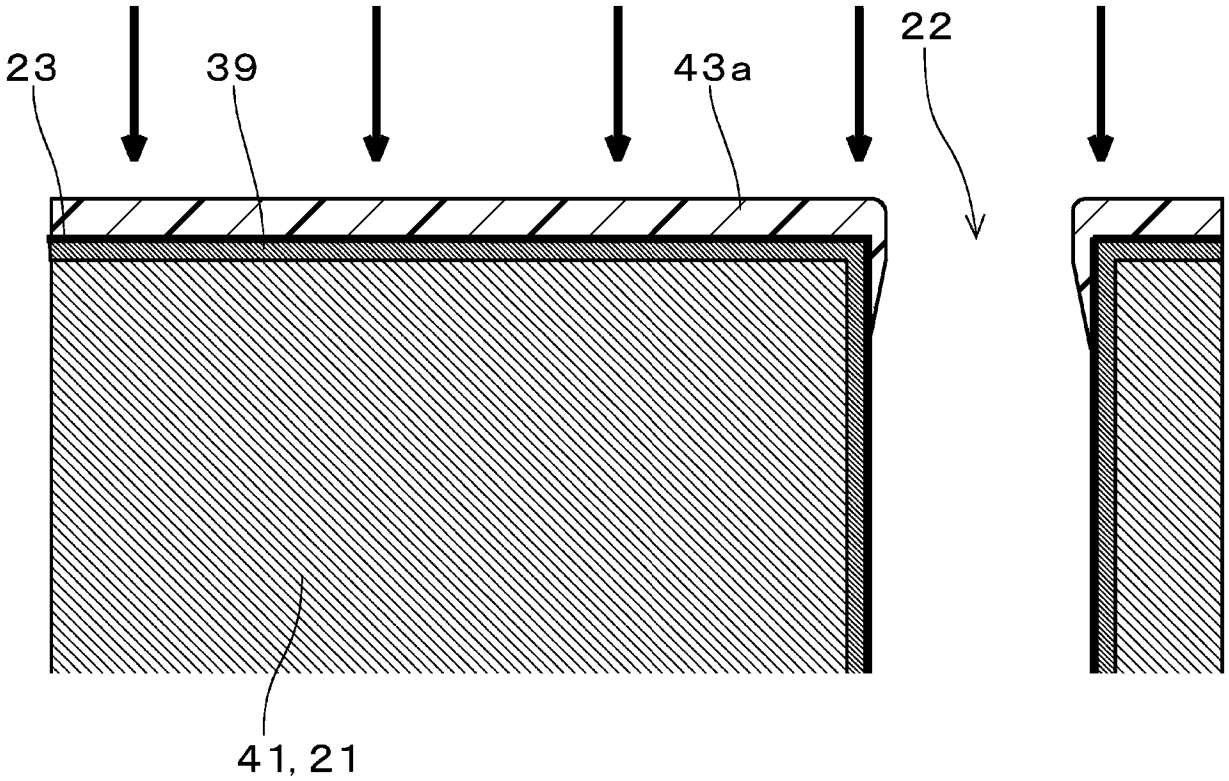
FIG. 12 is a state transition diagram of a cross-section for explaining a method of manufacturing a nozzle plate of a second embodiment.

Further, in the case where the intensity of the radiation upon cross-linking the non-cross-linked fluororesin is strong, the surface of the liquid repelling layer 40 on the nozzle surface 23 may be damaged. In particular, in the case where it is desired to increase the thickness of the liquid repelling layer 40, the surface of the liquid repelling layer 40 is susceptible to damage because the intensity of radiation necessary for cross-linking the non-cross-linked-fluororesin-containing layer 43 increases in accordance with the thickness of the non-cross-linked-fluororesin-containing layer 43. In such a case, as illustrated in FIG. 11, it is preferable to polish the surface of the liquid repelling layer 40 by performing polishing after the cross-linking. Further, the broken line in FIG. 11 represents the liquid repelling layer 40 before being polished. As a method of polishing the liquid repelling layer 40, for example, a chemical mechanical polishing (CMP) method, a method of irradiating an ion beam, or the like can be used. In this way, by polishing the liquid repelling layer 40, even if the surface of the liquid repelling layer 40 is damaged, the damaged portion can be removed. In addition, the thickness of the liquid repelling layer 40 can also be adjusted. Further, note that the polishing may be performed at any timing as long as it is after the cross-linking. For example, it may be performed in a state where the substrate 41 has yet to be divided into individual ones of the nozzle plates 21, or even in a state where, after the substrate has been divided into individual ones of the nozzle plates 21, the actuator unit 14 and the communication substrate 24 are joined.

Furthermore, in the method of manufacturing the nozzle plate 21 in a second embodiment illustrated in FIG. 12 to FIG. 15, the liquid repelling layer 40 is formed by alternately repeating the non-cross-linked-fluororesin-containing layer stacking and the cross-linking. More specifically, as in the first embodiment, first, the nozzle 22 and the protective layer 39 are formed on the substrate 41. Next, in the first non-cross-linked-fluororesin-containing layer stacking, a first non-cross-linked-fluororesin thin layer 43*a* is formed on the nozzle surface 23 as in the non-cross-linked-fluororesin-containing layer stacking in the first embodiment. Then, similarly to the cross-linking in the first embodiment, in the first cross-linking, the first non-cross-linked-fluororesin thin layer 43*a* is heated in a low oxygen atmosphere and irradiated with radiation (see FIG. 12). Consequently, the first non-cross-linked-fluororesin thin layer 43*a* is cross-linked, and a first liquid repelling thin layer 40*a* is formed on the nozzle surface 23.

Figure 13:
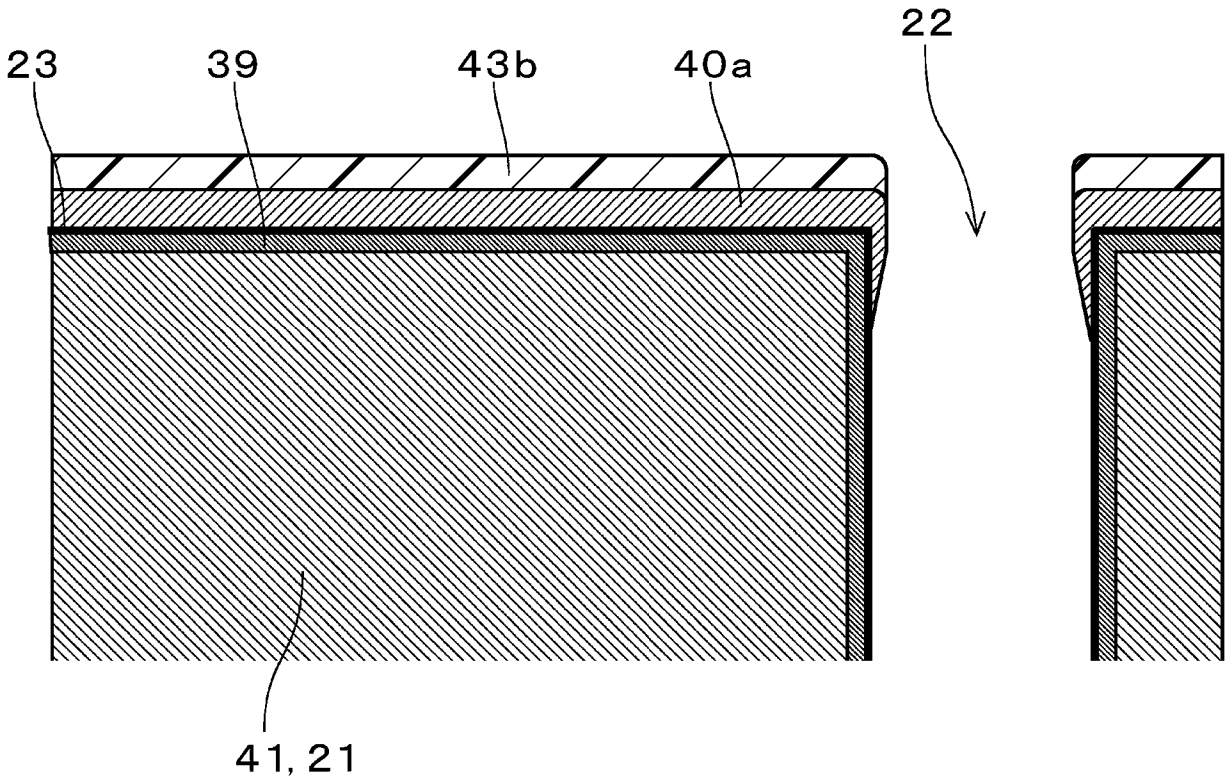
FIG. 13 is a state transition diagram of a cross section for explaining the method of manufacturing the nozzle plate of the second embodiment.
Figure 14:
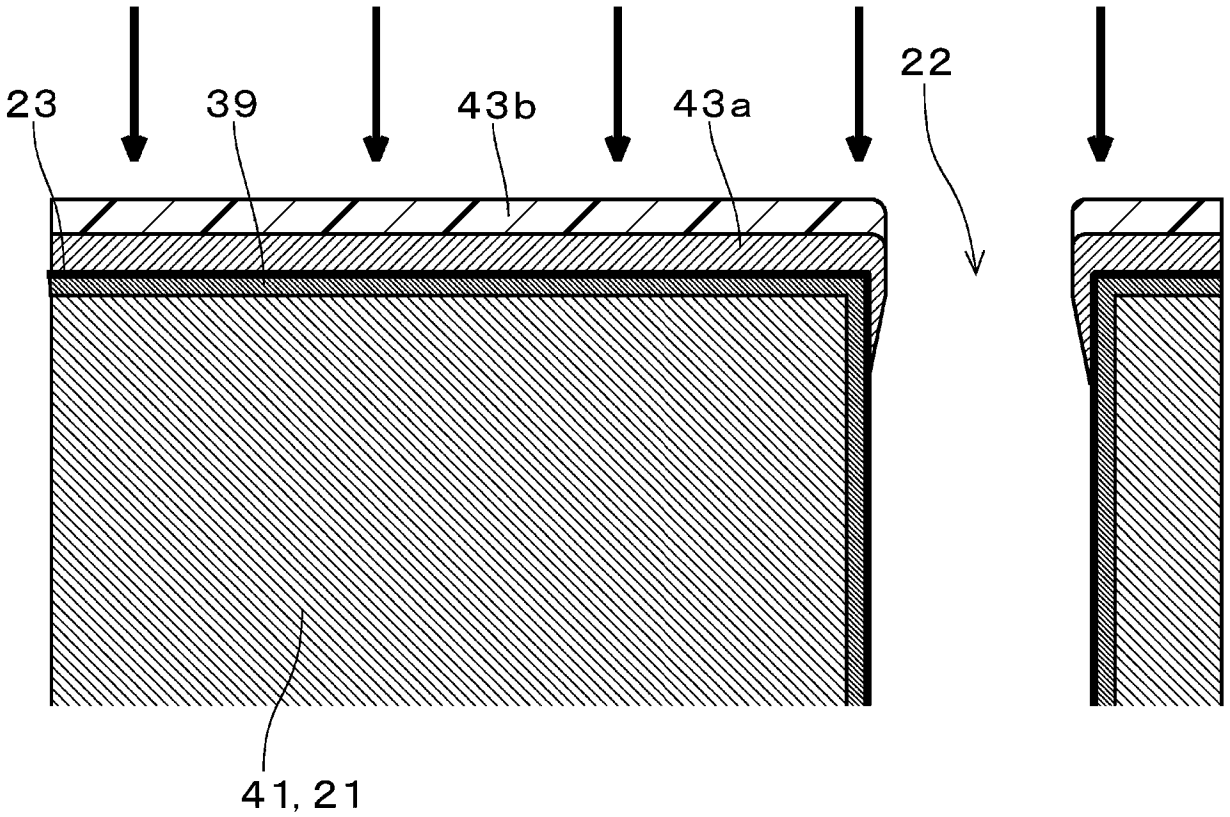
FIG. 14 is a state transition diagram of a cross section for explaining the method of manufacturing the nozzle plate of the second embodiment.
Figure 15:
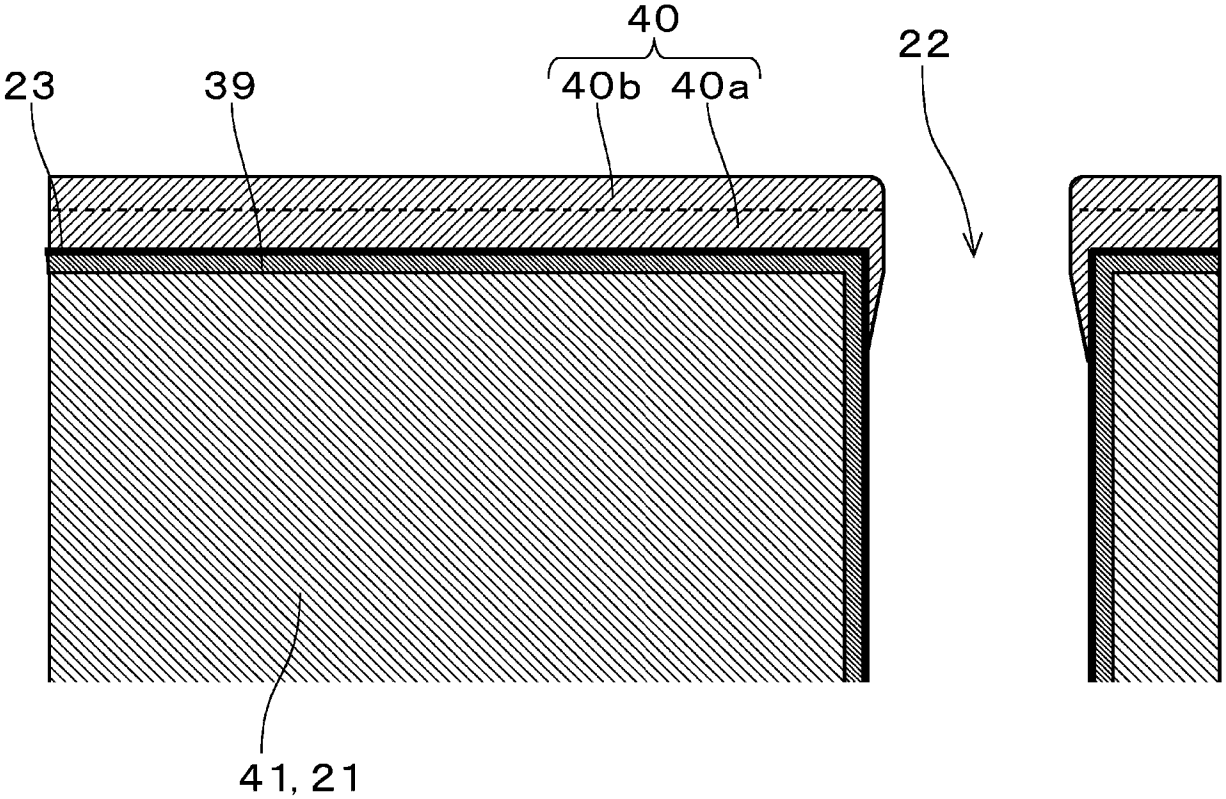
FIG. 15 is a state transition diagram of a cross section for explaining the method of manufacturing the nozzle plate of the second embodiment.

After forming the first liquid repelling thin layer 40*a*, in the second non-cross-linked-fluororesin-containing layer stacking, as in the first non-cross-linked-fluororesin-containing layer stacking, a second non-cross-linked-fluororesin thin layer 43*b* is formed again on the nozzle surface 23. As a result, as illustrated in FIG. 13, the second non-cross-linked-fluororesin thin layer 43*b* is stacked on the first liquid repelling thin layer 40*a*. In this state, in the second cross-linking, as in the first cross-linking, the second non-cross-linked-fluororesin thin layer 43*b* is heated in a low oxygen atmosphere and irradiated with radiation (refer to FIG. 14). Thereby, the second non-cross-linked-fluororesin thin layer 43*b* is cross-linked and becomes a second liquid repelling thin layer 40*b*. In addition, the first liquid repelling thin layer 40*a* and the second liquid repelling thin layer 40*b* are cross-linked. As a result, as illustrated in FIG. 15, the liquid repelling layer 40 composed of the first liquid repelling thin layer 40*a* and the second liquid repelling thin layer 40*b* is formed. Further, because the subsequent steps are the same as those of the first embodiment described above, description thereof will be omitted.

In this way, by alternately repeating the non-cross-linked-fluororesin-containing layer stacking and the cross-linking to form the liquid repelling layer 40, compared with the case where the non-cross-linked-fluororesin-containing layer stacking and the cross-linking are performed once, it is possible to suppress variations (unevenness) in the thickness of the non-cross-linked-fluororesin-containing layer 43 and eventually the liquid repelling layer 40. In addition, because variations in the thickness of the non-cross-linked-fluororesin-containing layer 43 can be suppressed, variations in the degree of progress of the cross-linking reaction can also be suppressed, and, in turn, variations in the hardness of the liquid repelling layer 40 can be suppressed. Such an effect becomes marked particularly in the case where the thickness of the liquid repelling layer 40 is large. In short, because the thicker the non-cross-linked-fluororesin-containing layer 43 formed at a time is, the more easily the thickness varies, in this embodiment, by dividing the formation of the non-cross-linked-fluororesin-containing layer 43 into a plurality of steps, the thickness of the non-cross-linked-fluororesin-containing layer 43 formed at one time is reduced, and variation in the thickness thereof is suppressed.

In the second embodiment, the non-cross-linked-fluororesin-containing layer stacking and the cross-linking are repeated two times, but the invention is not limited thereto. The non-cross-linked-fluororesin-containing layer stacking and the cross-linking may be alternately repeated two or more times. Further, in each non-cross-linked-fluororesin-containing layer stacking (in the second embodiment, the first non-cross-linked-fluororesin-containing layer stacking and the second non-cross-linked-fluororesin-containing layer stacking), in the case where the dispersion is applied to the nozzle surface 23 by dip coating, it is preferable that after immersing the substrate 41 in the dispersion liquid, the direction in which the substrate 41 is pulled from the liquid (hereinafter, immersion direction) be different. For example, the immersion direction in the first non-cross-linked-fluororesin-containing layer stacking and the immersion direction in the second non-cross-linked-fluororesin-containing layer stacking are made substantially orthogonal to each other. In this way, it is possible to suppress variations in the thickness of the liquid repelling layer even when there is a possibility that uneven application of the dispersion due to dip coating may occur. Furthermore, it is preferable that the relative movement direction of the substrate 41 with respect to the irradiation of radiation be different in each cross-linking (the first cross-linking and the second cross-linking in the second embodiment). For example, the relative movement direction of the substrate 41 in the first cross-linking and the relative movement direction of the substrate 41 in the second cross-linking are set to be substantially orthogonal to each other. This makes it possible to suppress variations in the hardness of the liquid repelling layer. In addition, in each non-cross-linked-fluororesin-containing layer stacking, particularly the non-cross-linked-fluororesin-containing layer stacking after the first non-cross-linked-fluororesin-containing layer stacking (for example, the second non-cross-linked-fluororesin-containing layer stacking), the dispersion liquid applied to the nozzle surface 23 is preferably a liquid containing a fluorine-based inert liquid, a surfactant, or the like. In this way, the second liquid repelling thin layer can be more smoothly formed on the first liquid repelling thin layer that can easily repel liquid.

Figure 16:
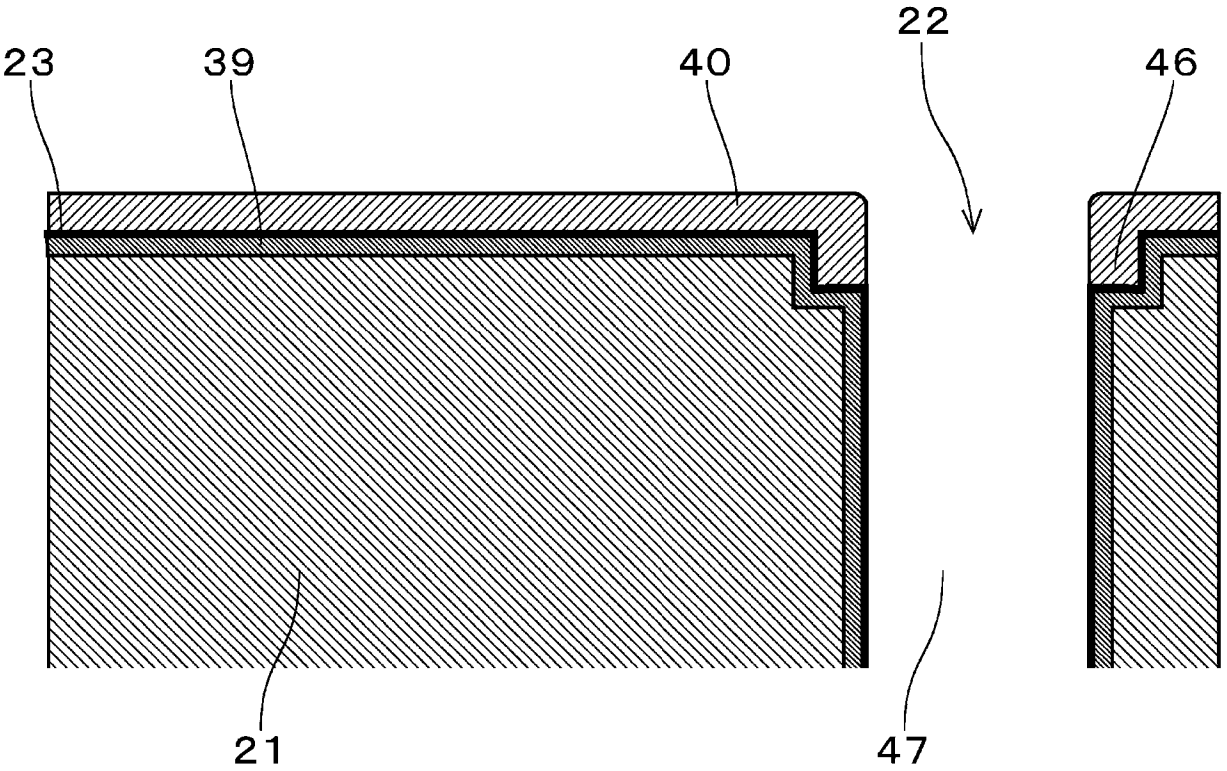
FIG. 16 is a schematic diagram for explaining a first modification example of the nozzle plate.
Figure 17:
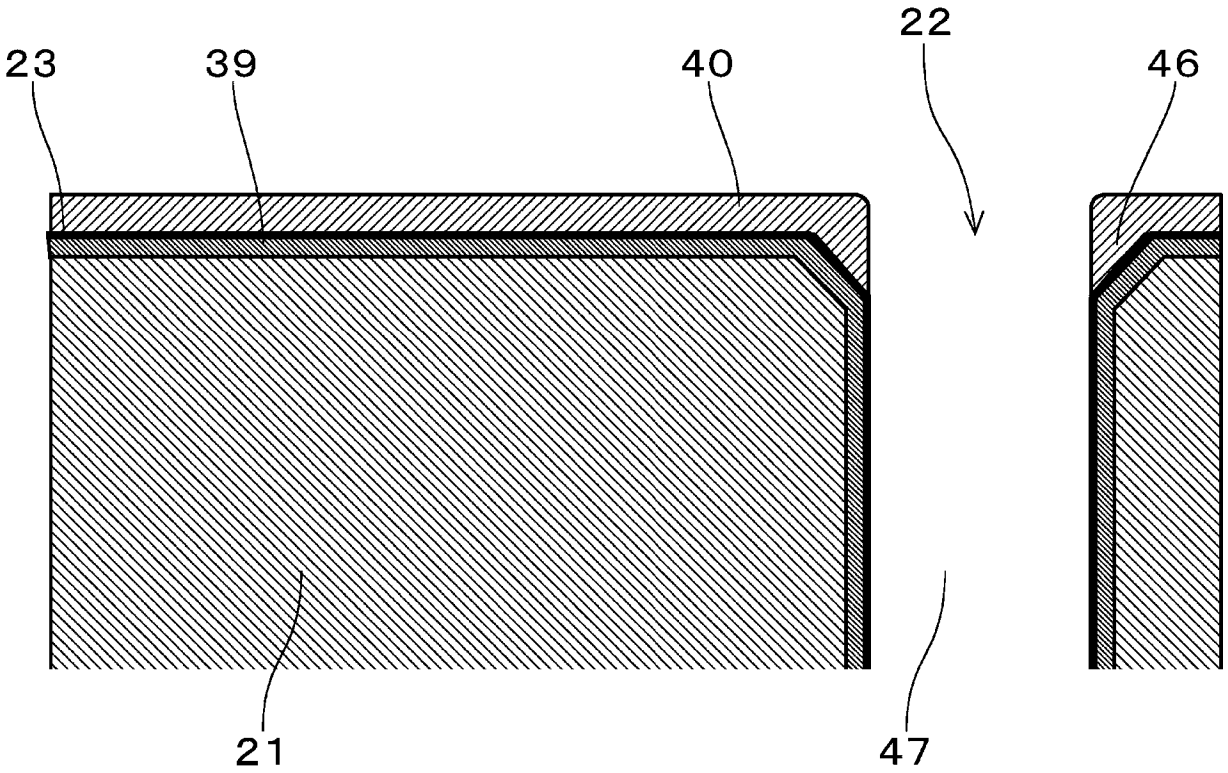
FIG. 17 is a schematic diagram for explaining a second modification example of the nozzle plate.
Figure 18:
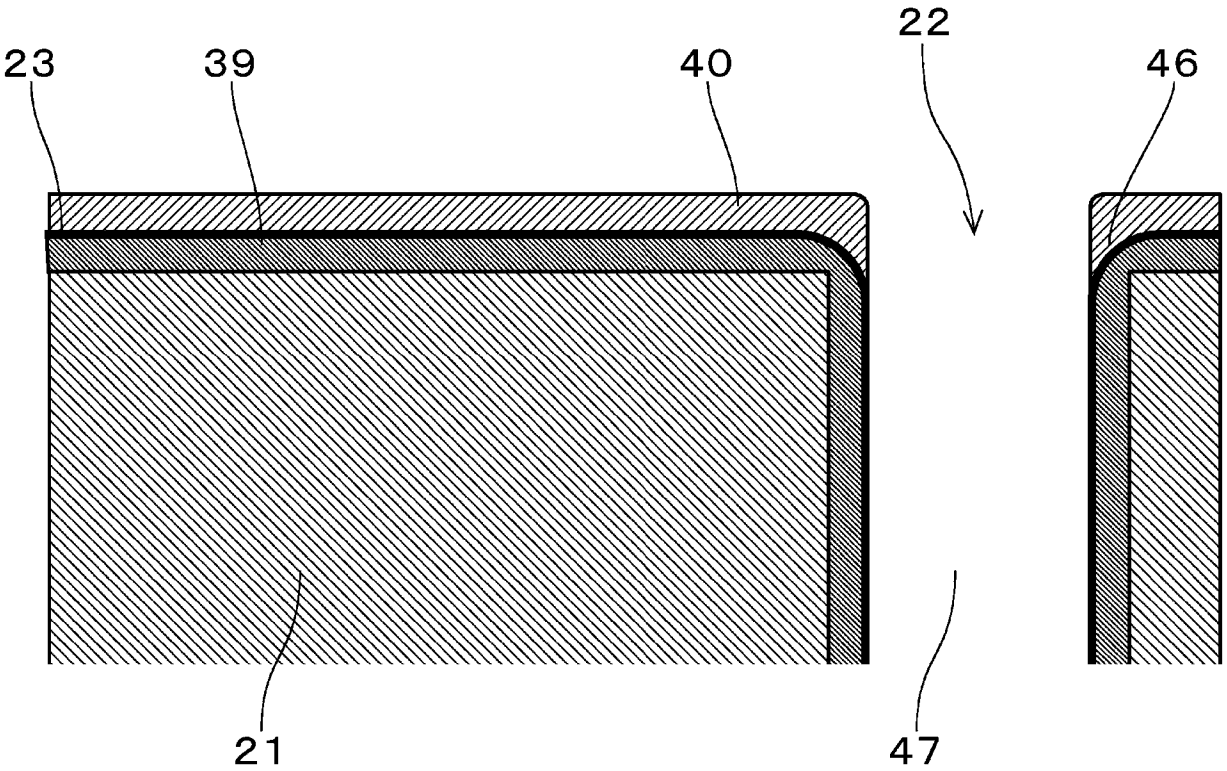
FIG. 18 is a schematic diagram for explaining a third modification example of the nozzle plate.

In the above description, the liquid repelling layer 40 is configured to remain thin in the vicinity of the opening on the inner surface of the nozzle 22 on the side of the nozzle surface 23, but the invention is not limited thereto. For example, in the modification example of the nozzle plate 21 illustrated in FIG. 16 to FIG. 18, the liquid repelling layer 40 is configured to remain in the vicinity of the opening on the inner surface of the nozzle 22 on the side of the nozzle surface 23. Further, FIG. 16 is a schematic view for explaining a first modification example of the nozzle plate 21. In addition, FIG. 17 is a schematic view for explaining a second modification example of the nozzle plate 21. Furthermore, FIG. 18 is a schematic view for explaining a third modification example of the nozzle plate 21.

Specifically, in the first modification, as illustrated in FIG. 16, the nozzle 22 includes a first portion 46 and a second portion 47. The first portion 46 is a portion including an opening on the side of the nozzle surface 23 and is a portion where the nozzle plate 21 and the protective layer 39 that form the base of the nozzle 22 are larger in diameter than the second portion 47. In other words, the nozzle 22 (nozzle in a narrow sense, corresponding to the nozzle of the invention) formed by the nozzle plate 21 and the protective layer 39 includes the first portion 46 that has a diameter that increases from the middle in the extending direction of the nozzle 22 (in this modification example, in the thickness direction of the nozzle plate 21) toward the opening on the nozzle surface 23 side. That is, in the nozzle plate 21 and the protective layer 39 serving as the base of the nozzle 22, the diameter of the opening in the first portion 46 is formed so as to be larger than the diameter of the second portion 47. The second portion 47 is a portion that communicates with the first portion 46 and extends in a direction perpendicular to the nozzle surface 23 from a position connected to the first portion 46 to a midway portion on the side opposite to the nozzle surface 23. Further, as illustrated in FIG. 19 to FIG. 24, a portion of the nozzle 22 on the opposite side to the first portion 46 with the second portion 47 interposed therebetween and including an opening on the side opposite to the nozzle surface 23 side is formed to have a diameter larger than the diameter of the first portion 46. In other words, the opening diameter of the nozzle 22 on the side opposite to the nozzle surface 23 side is larger than the opening diameter of the nozzle 22 on the nozzle surface 23 side. Further, the opening diameter of the nozzle 22 on the nozzle surface 23 side may be formed to be the same diameter as the opening diameter of the nozzle 22 on the side opposite to the nozzle surface 23 side. Alternatively the opening diameter of the nozzle 22 on the nozzle surface 23 side may be larger than the opening diameter of the nozzle 22 on the side opposite to the nozzle surface 23 side.

In addition, as illustrated in FIG. 16, the inner surface of the first portion 46 in this modification example has a stepped shape that goes down by one step from the edge of the opening on the nozzle surface 23 side (in other words, recessed toward the side opposite to the nozzle surface 23 side). That is, the first portion 46 is formed in a state in which the edge corner of the opening on the nozzle surface 23 side of the nozzle plate 21 is notched. Further, such a stepped notch can be formed by processing the nozzle plate 21 by etching or the like. The liquid repelling layer 40 is formed inside the first portion 46. In this embodiment, the inner surface of the second portion 47 of the portion on the nozzle surface 23 side of the nozzle 22 and the surface of the liquid repelling layer 40 formed in the first portion 46 are aligned at approximately the same position. In other words, a portion of the nozzle 22 (the nozzle in a broad sense including the surface of the liquid repelling layer 40) on the side of the nozzle surface 23 (that is, a portion obtained by combining the first portion 46 and the second portion 47) is formed in a straight shape. Further, note that a configuration in which the surface of the liquid repelling layer 40 is formed at a position different from the inner surface of the second portion 47 of the nozzle 22 (for example, a position inside or outside of the inner surface) (that is, a configuration in which a step is formed in the first portion 46 of the nozzle 22) can also be adopted.

In the second modification example, as illustrated in FIG. 17, the inner surface of the first portion 46 is formed in a shape chamfered diagonally at the edge corner of the opening of the nozzle 22, that is, a C-chamfered shape. Such a chamfered shape can be formed, for example, by processing the nozzle plate 21 by etching or the like. Also, in this modification example, the liquid repelling layer 40 is formed inside the first portion 46. In addition, in this modification example, among the portions of the nozzle 22 on the nozzle surface 23 side, the inner surface of the second portion 47 and the surface of the liquid repelling layer 40 formed in the first portion 46 are aligned at substantially the same position. Further, because other configurations and the like are the same as those of the first modification example described above, description thereof is omitted.

Furthermore, in the third modification example, as illustrated in FIG. 18, the inner surface of the first portion 46 is formed in a shape in which the corner of the edge of the opening of the nozzle 22 is rounded, that is, an R-chamfered shape. In this modified example, the R-chamfered shape is not formed in the nozzle plate 21, but is formed in the protective layer 39. Such a chamfered shape can be formed by adjusting the thickness of the protective layer 39 to make the surface of the protective layer 39 formed at the corner rounded. Further, the R-chamfered shape can also be formed on the nozzle plate 21 itself by etching or the like. Also, in this modification example, the liquid repelling layer 40 is formed inside the first portion 46. In addition, in this modification example, among the portions of the nozzle 22 on the nozzle surface 23 side, the inner surface of the second portion 47 and the surface of the liquid repelling layer 40 formed in the first portion 46 are aligned at substantially the same position. Further, because other configurations and the like are the same as those of the first modification example described above, description thereof is omitted.

By forming the liquid repelling layer 40 in the first portion 46 as in the first to third modification examples, wear of the liquid repelling layer 40 at the edge of the opening on the nozzle surface 23 side of the nozzle 22 can be suppressed. This makes it possible to suppress degradation of the liquid repellency at the edge of the nozzle opening of the nozzle surface 23. That is, because the film thickness of the liquid repelling layer 40 at the edge of the nozzle 22 side of the nozzle 22, which is liable to be worn by the wiping operation of the wiper 12, can be increased, even if the liquid repelling layer 40 in that region wears, it is possible to maintain liquid repellency. As a result, adhesion of ink to the edge of the opening of the nozzle 22 on the nozzle surface 23 can be suppressed more reliably. Accordingly, it is possible to suppress malfunctions such as the ink droplets ejected from the nozzles 22 interfering with the ink adhering to the nozzle surface 23 and the flight direction of the ink droplets consequently becoming bent. In addition, as described above, because the inner surface of the first portion 46 is formed in a stepped shape, a C-chamfered shape, or an R-chamfered shape, the first portion 46 can be easily manufactured by etching and film formation of the protective layer 39. In other words, the processing of the first portion 46 of the nozzle plate 21 is facilitated, which further facilitates the processing of the nozzle plate 21. Furthermore, as in the second and third modification examples, by forming the inner surface of the first portion 46 into a chamfered shape, when radiation is irradiated from above in the cross-linking, it becomes easy to apply radiation to the inner surface of the first portion 46. As a result, the protective layer 39 on the inner surface of the first portion 46 and the liquid repelling layer 40 easily undergo a cross-linking reaction, and the liquid repelling layer 40 can be firmly fixed in the first portion 46.

In the method of manufacturing the nozzle plate 21 according to the first embodiment and the second embodiment described above, the non-cross-linked-fluororesin-containing layer 43 and hence the liquid repelling layer 40 are formed by using a dispersion, but the invention is not limited thereto. In the method of manufacturing the nozzle plate 21 in the third embodiment illustrated in FIG. 19 to FIG. 24, the liquid repelling layer 40 is formed by using a resin sheet 48. Further, although the method of manufacturing the nozzle plate 21 in the third embodiment can be applied to any of the nozzle plates 21 exemplified in each of the above-described embodiments and each of the modification examples, in the following description, the nozzle plate 21 of the first modification example illustrated in FIG. 16 is described by way of example. FIGS. 19 to 24 are state transition diagrams of the cross section of the nozzle plate 21 (the substrate 41).

Figure 19:
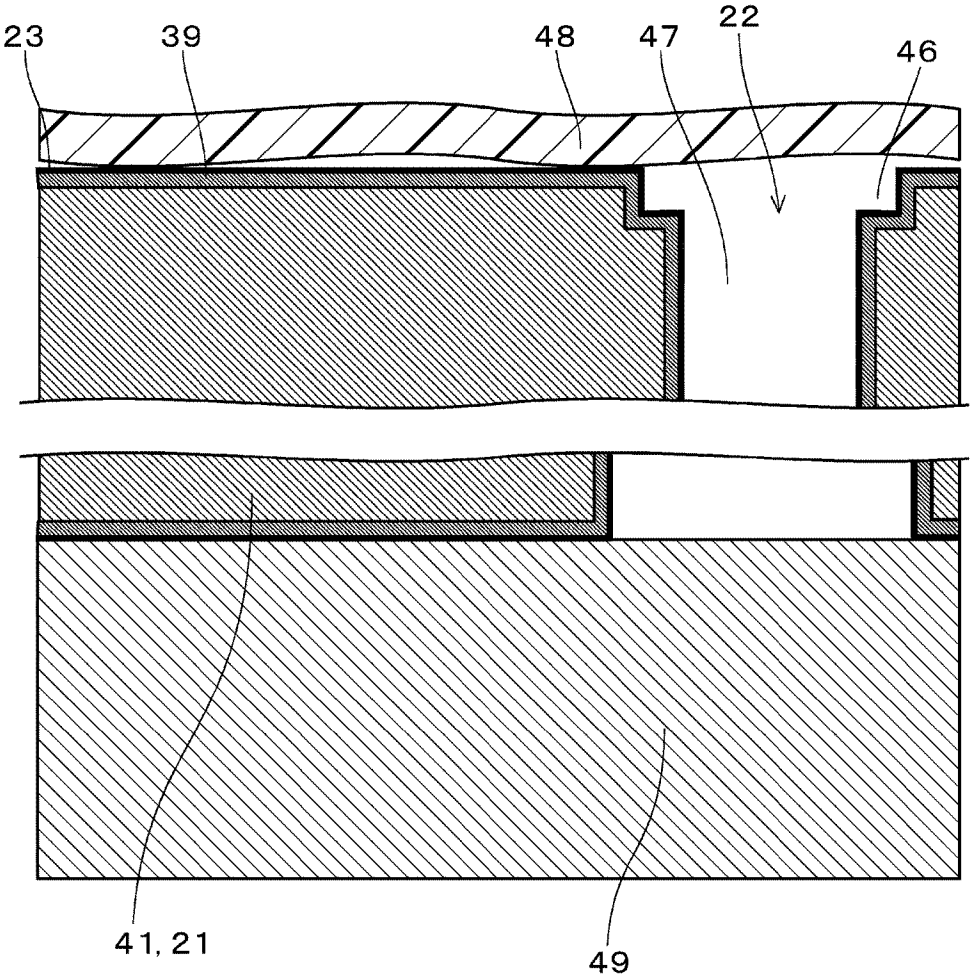
FIG. 19 is a state transition diagram of a cross section for explaining a method of manufacturing a nozzle plate of a third embodiment.

First, as in the first embodiment, the nozzle 22 and the protective layer 39 are formed in the substrate 41. This time, the first portion 46 and the like are also formed in the nozzle 22. Next, in the non-cross-linked-fluororesin-containing layer stacking, the non-cross-linked-fluororesin-containing layer 43 containing non-cross-linked fluororesin prior to cross-linking is stacked on the nozzle surface 23 side. Specifically, as illustrated in FIG. 19, the substrate 41 is placed on a stage 49 with the nozzle surface 23 side facing upward. Further, a suction pump (not illustrated) and a heating mechanism (not illustrated) are attached to the stage 49. In addition, inside the stage 49, a gas channel (not illustrated) connected to the suction pump is formed. Therefore, when the suction pump is operated, the substrate 41 and the like on the stage 49 are adsorbed toward the stage 49 side. Further, if the heating mechanism is operated, the stage 49 is heated, and the substrate 41 and the like on the stage 49 are heated. Next, the resin sheet 48 (for example, a PTFE sheet, a PFA sheet, an FEP sheet, or the like) containing a non-cross-linked fluororesin having no polymerizable group is superimposed on the substrate 41 placed on the stage 49.

Figure 20:
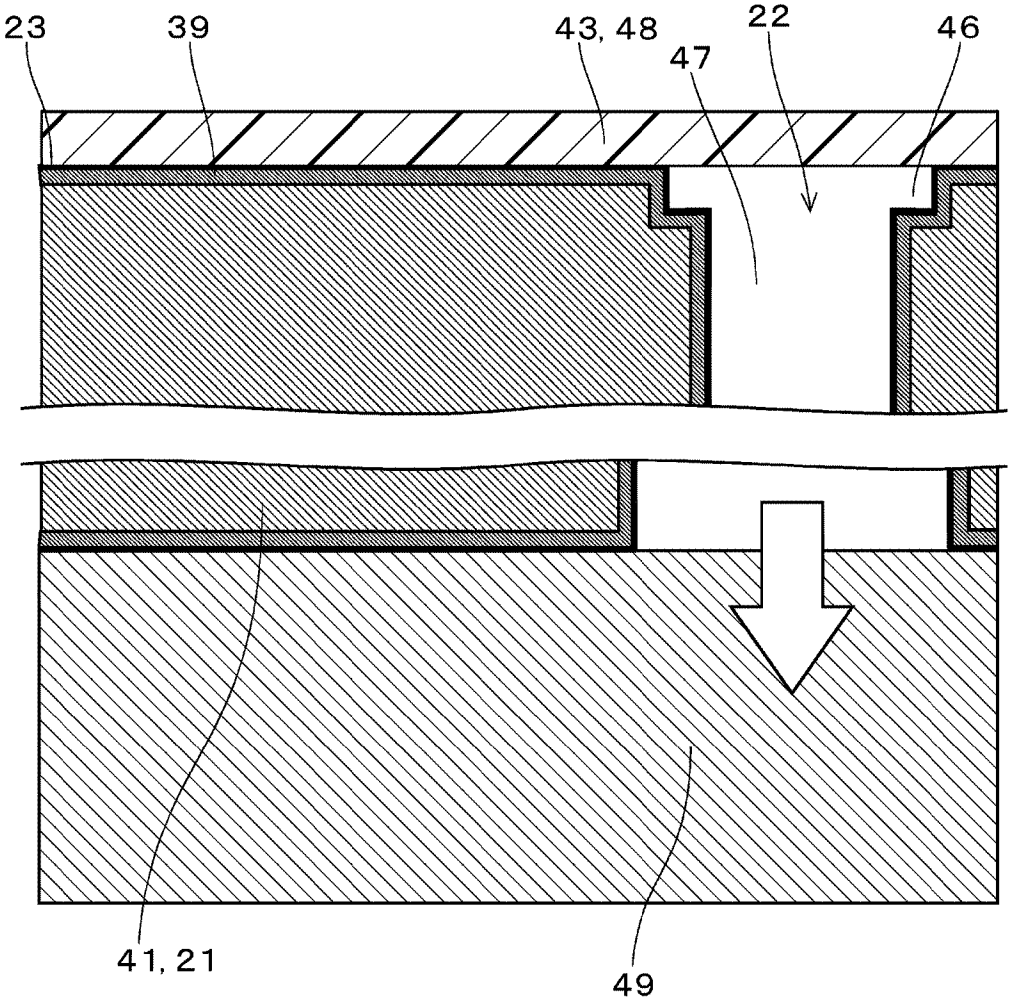
FIG. 20 is a state transition diagram of a cross section for explaining the method of manufacturing the nozzle plate of the third embodiment.

Here, as illustrated in FIG. 19, merely placing the resin sheet 48 on the nozzle surface 23 of the substrate 41 causes the resin sheet 48 to bend or wrinkle and there is a possibility that gaps will be formed between the resin sheet 48 and the substrate 41. Therefore, in this embodiment, as illustrated in FIG. 20, by sucking the resin sheet 48 through the nozzle 22 by the operation of the suction pump (refer to the hollow arrow in FIG. 20), the resin sheet 48 is pressed against the substrate 41. Consequently, the resin sheet 48 is brought into close contact with the nozzle surface 23 of the substrate 41. That is, the non-cross-linked-fluororesin-containing layer 43 is stacked on the nozzle surface 23 side. Further, as long as the resin sheet 48 can be brought into close contact with the nozzle surface 23 of the substrate 41, it is not limited to a method of sucking the resin sheet 48 with the suction pump. For example, it is possible to grip the substrate 41 and the resin sheet 48 with a clamp, to bring the substrate 41 and the resin sheet 48 into close contact with each other by using an electrostatic force, or to press with a transparent plate from above the substrate 41 with the resin sheet 48 interposed therebetween. In addition, it is possible to adopt a method in which heat is applied by operation of a heating mechanism to weld a part of the resin sheet 48 to the nozzle surface 23 and temporarily fix the resin sheet 48 in close contact with the nozzle surface 23 of the substrate 41. Further, the arranging of the resin sheet 48 on the nozzle surface 23 and the adsorbing (close contact) of the resin sheet 48 to the nozzle surface 23 correspond to the sheet arranging of the invention.

Figure 21:
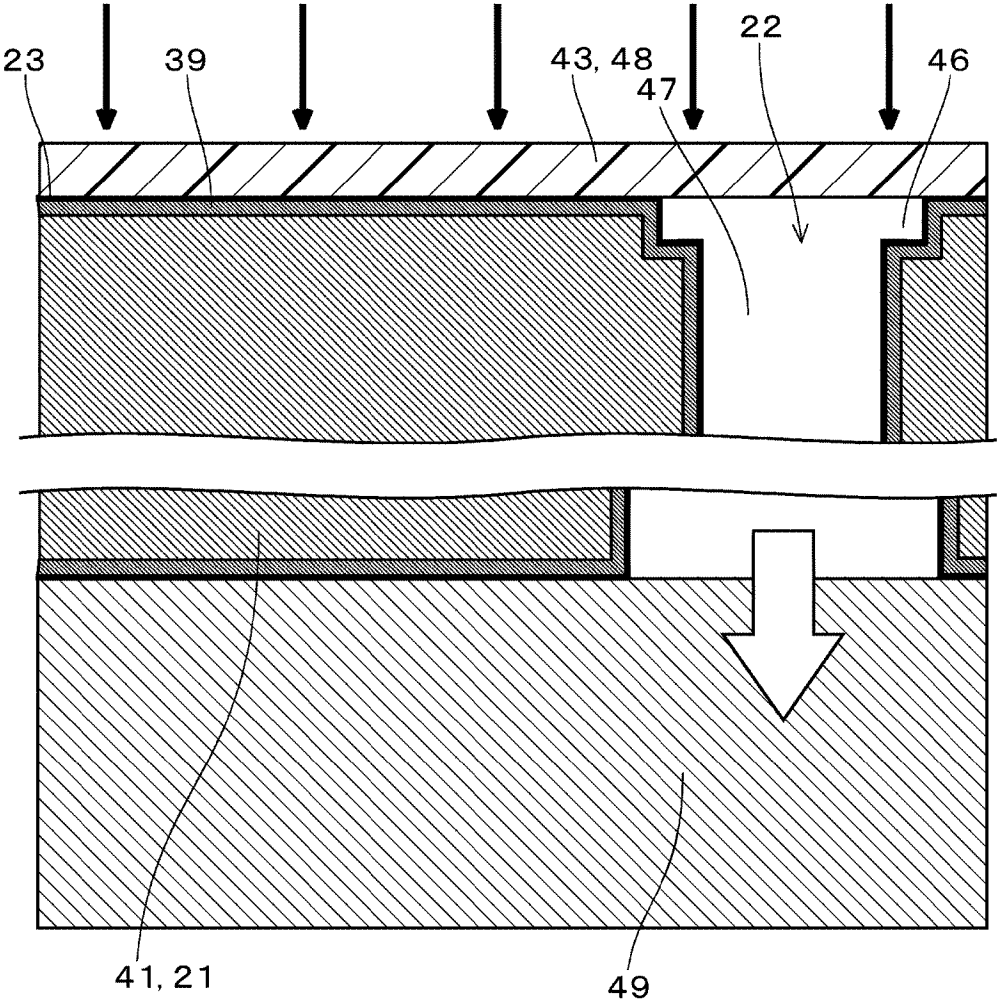
FIG. 21 is a state transition diagram of a cross section for explaining the method of manufacturing the nozzle plate of the third embodiment.
Figure 22:
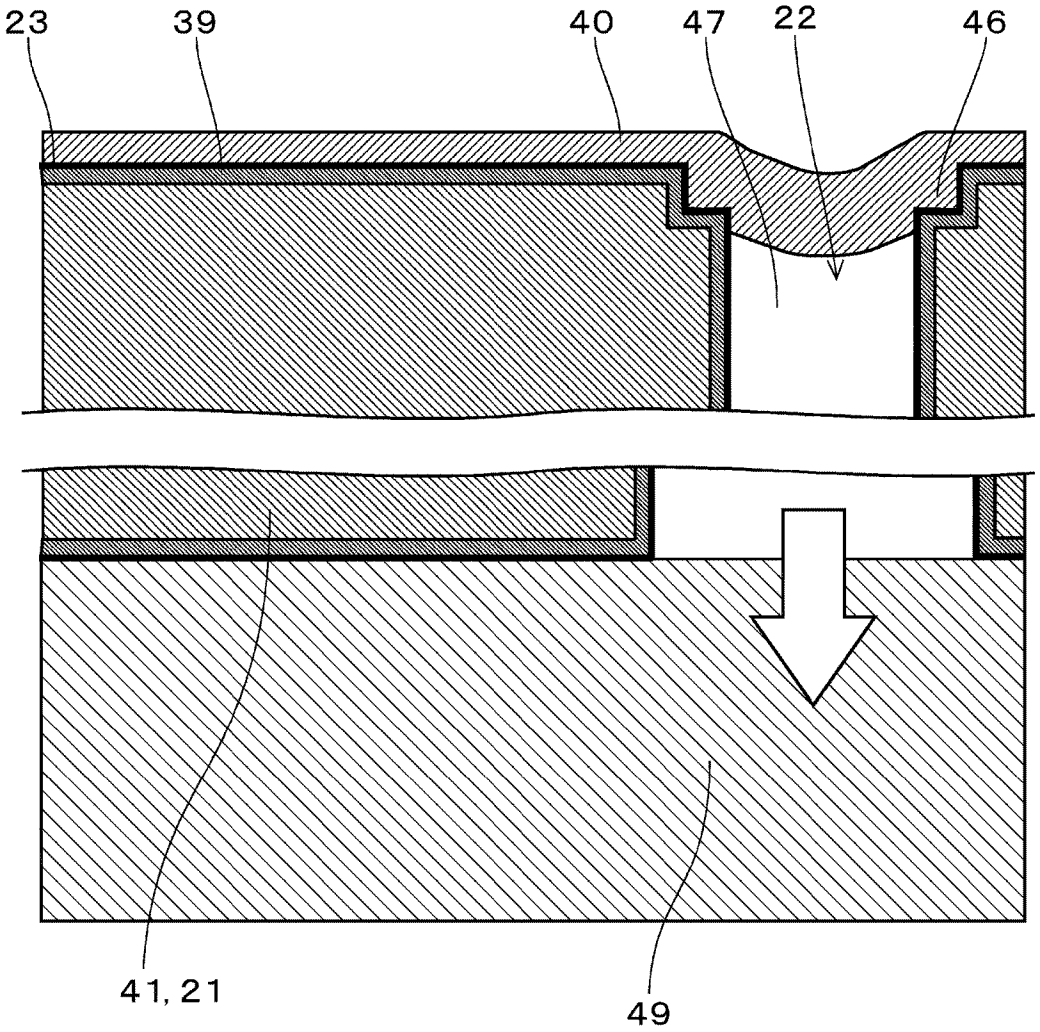
FIG. 22 is a state transition diagram of a cross-section for explaining the method of manufacturing the nozzle plate of the third embodiment.

Once the resin sheet 48 is adsorbed to the substrate 41 and the non-cross-linked-fluororesin-containing layer 43 is stacked on the nozzle surface 23 side, the cross-linking of the non-cross-linked-fluororesin-containing layer 43 to form the liquid repelling layer 40 is performed. In this embodiment, as illustrated in FIG. 21, while the resin sheet 48 is attracted to the stage 49 side by operation of a pump (refer to the hollow arrow in FIG. 21), the non-cross-linked-fluororesin-containing layer 43 (that is, the resin sheet 48) is heated under the same conditions as in the cross-linking in the first embodiment. In this state, as in the cross-linking in the first embodiment, the non-cross-linked-fluororesin-containing layer 43 is irradiated with radiation (refer to arrow in FIG. 21). Consequently, the non-cross-linked-fluororesin-containing layer 43 is cross-linked to form the liquid repelling layer 40. Here, in this embodiment, because the non-cross-linked-fluororesin-containing layer 43 is cross-linked while sucking the resin sheet 48 from the nozzle 22 by operating the suction pump, as illustrated in FIG. 22, the liquid repelling layer 40 at the portion covering the nozzle 22 is formed in a state bent toward the stage 49 side. Accordingly, in the configuration in which the nozzle 22 has the first portion 46, the non-cross-linked-fluororesin-containing layer 43 enters the first portion 46 of the nozzle 22 and is easily cross-linked. That is, it is easy to form the liquid repelling layer 40 in the first portion 46.

Figure 23:
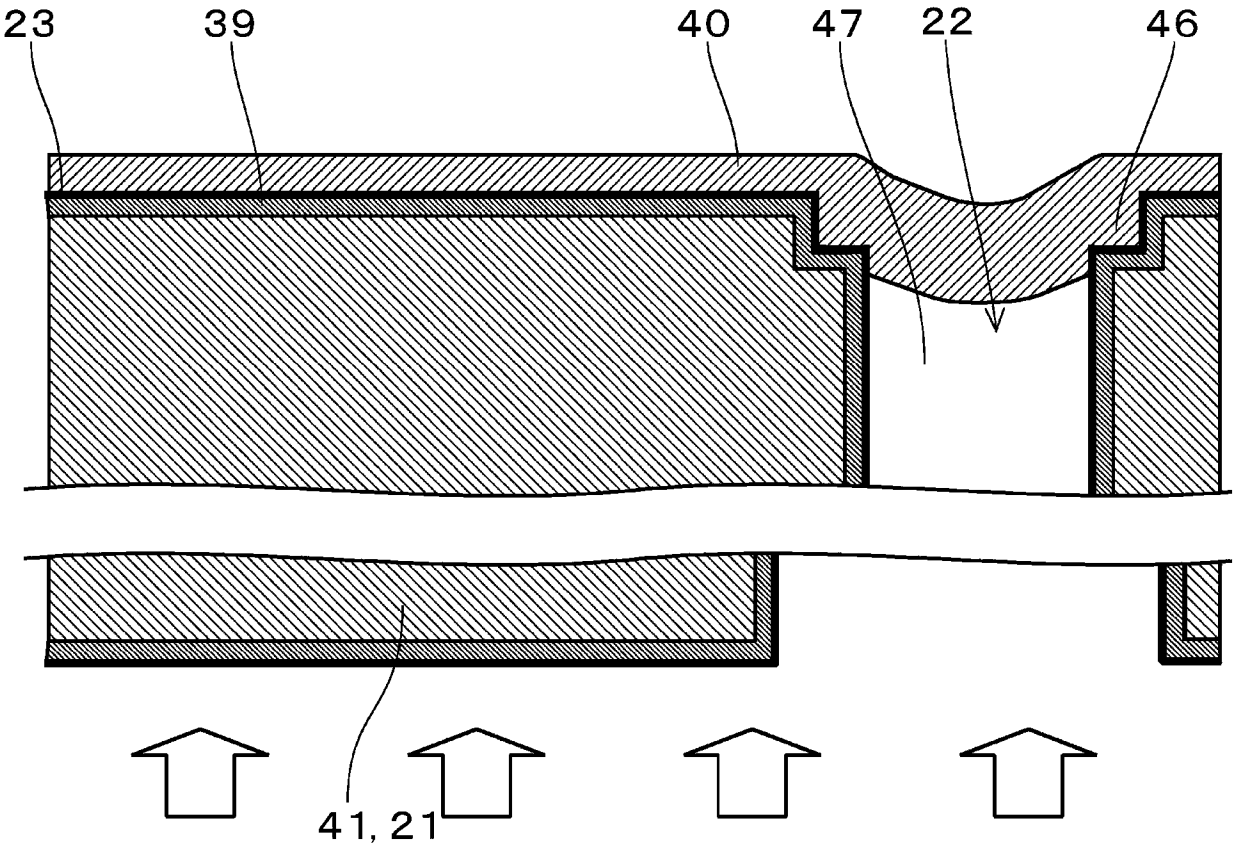
FIG. 23 is a state transition diagram of a cross section for explaining the method of manufacturing the nozzle plate of the third embodiment.
Figure 24:
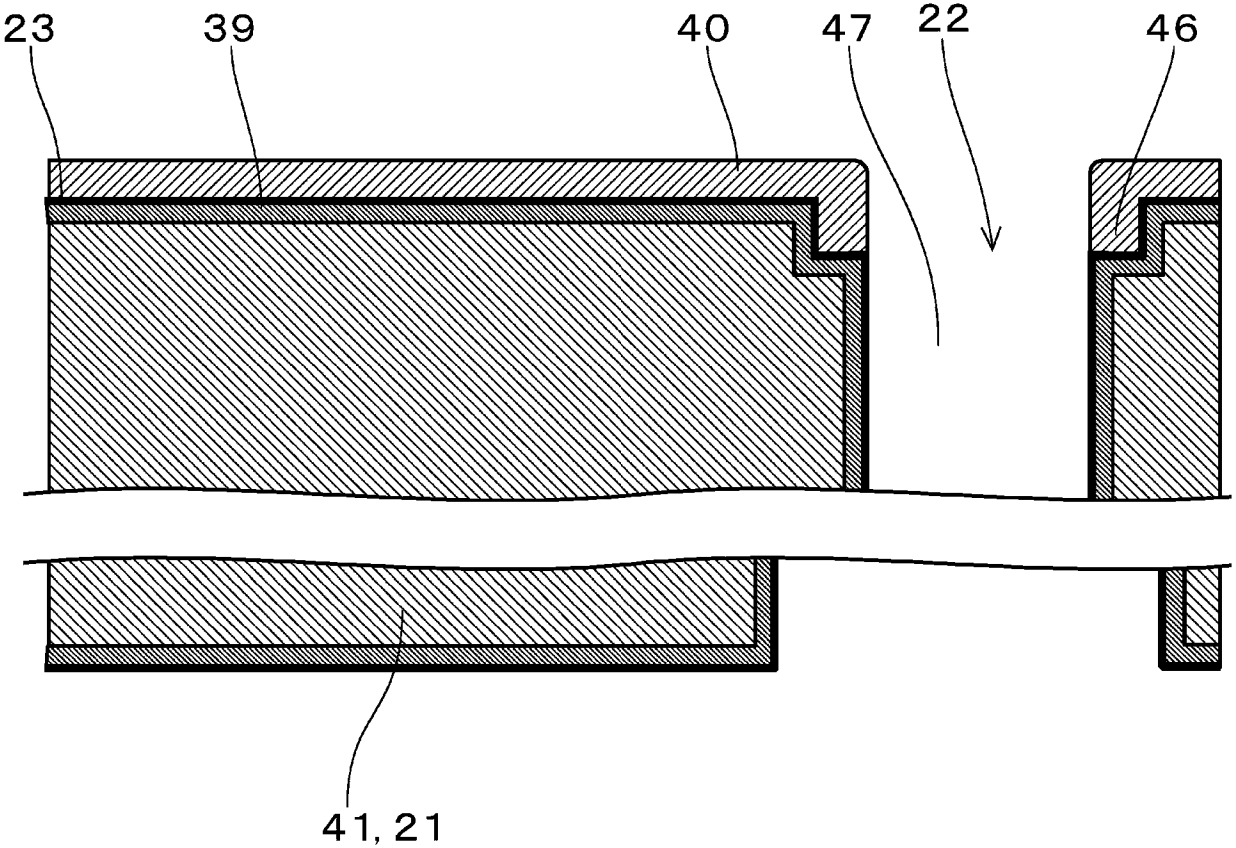
FIG. 24 is a state transition diagram of a cross section for explaining the method of manufacturing the nozzle plate of the third embodiment.

Thereafter, in the removal, the liquid repelling layer 40 covering the nozzle 22 or entering the nozzle 22 is removed. For example, as illustrated in FIG. 23, the ion beam is irradiated from the side opposite to the nozzle surface 23 as in the modification example of the removal in the first embodiment (refer to the hollow arrow in FIG. 23). As a result, as illustrated in FIG. 24, the liquid repelling layer 40 covering the nozzle 22 or entering the nozzle 22 is removed, and the nozzle 22 exemplified in the first modification example is formed. Further, similarly to the removal in the first embodiment, the liquid repelling layer 40 in the region corresponding to the nozzle 22 can alternatively be removed by irradiating an ion beam or radiation from the nozzle surface 23 side in a state where a mask having a through hole formed at a position corresponding to the nozzle 22 is superposed on the liquid repelling layer 40 from the nozzle surface 23 side. In addition, as in the first embodiment, the surface of the liquid repelling layer 40 can also be polished by performing polishing after the cross-linking. Furthermore, even in the case of using the resin sheet 48, similarly to the manufacturing method of the nozzle plate 21 in the second embodiment, the liquid repelling layer 40 can be formed by alternately repeating the non-cross-linked-fluororesin-containing layer stacking and the cross-linking. Further, because the subsequent steps and the like are the same as those in the first embodiment described above, description thereof will be omitted.

As described above, also in this embodiment, because the liquid repelling layer 40 containing fluororesin is formed on the nozzle surface 23 of the nozzle plate 21, liquid repellency can be imparted to the nozzle surface 23 side of the nozzle plate 21. In addition, because the liquid repelling layer 40 contains a cross-linked fluororesin, abrasion resistance can be improved as compared with a fluororesin not cross-linked. As a result, deterioration of liquid repellency on the nozzle surface 23 of the nozzle plate 21 can be suppressed. In addition, because the liquid repelling layer 40 is bonded to the nozzle surface 23 by being cross-linked with the nozzle surface 23, it is possible to improve the adhesiveness (adhesion) of the liquid repelling layer 40 to the nozzle plate 21. As a result, separation of the liquid repelling layer 40 from the nozzle surface 23 can be suppressed. Furthermore, in this embodiment, because the non-cross-linked-fluororesin-containing layer stacking includes sheet arranging and the resin sheet 48 is brought into close contact with the nozzle surface 23 in the sheet arranging, the non-cross-linked-fluororesin-containing layer 43 can be easily stacked. In addition, because the non-cross-linked-fluororesin-containing layer 43 is formed using the resin sheet 48, the liquid repelling layer 40 that is smoother and that has few defects such as pinholes and cracks can be manufactured. In the cross-linking step, because the non-cross-linked-fluororesin-containing layer 43 is cross-linked while sucking the non-cross-linked-fluororesin-containing layer 43 (that is, the resin sheet 48) from the nozzle 22 to form the liquid repelling layer 40 in the first portion 46, the liquid repelling layer 40 can be more reliably formed inside the first portion 46. Further, even in the case where the non-cross-linked-fluororesin-containing layer 43 is formed by using a dispersion, the non-cross-linked-fluororesin-containing layer 43 can also be cross-linked while sucking the non-cross-linked-fluororesin-containing layer 43 from the nozzle 22. In this case as well, the liquid repelling layer 40 can be formed more reliably inside the first portion 46.

In addition, in each of the above-described embodiments, the nozzle plate 21 formed of silicon is illustrated, but the invention is not limited thereto. For example, a metal nozzle plate can be adopted. Furthermore, when the nozzle plate itself has ink resistance, it is possible to eliminate the protective layer on the surface of the nozzle plate. In this case, the liquid repelling layer is directly cross-linked and bonded to the surface of the nozzle plate. In addition, in each of the embodiments described above, a so-called bending vibration type piezoelectric element is exemplified as a driving element that causes a pressure variation in the ink in the pressure chamber 30, but the invention is not limited thereto. For example, various actuators such as a so-called longitudinal vibration type piezoelectric element, a heat generating element, an electrostatic actuator for changing the volume of a pressure chamber by utilizing electrostatic force, or the like can be adopted.

In the above description, the printer 1 of the ink jet type including the recording head 3 of the ink jet type, which is one type of liquid ejecting head, has been described as an example of the liquid ejecting apparatus; however, the invention is also applicable to a liquid ejecting apparatus provided with another liquid ejecting head. For example, it is possible to apply the invention to a liquid ejecting apparatus provided with a color material ejecting head used for the manufacture of color filters such as those of liquid crystal displays, an electrode material ejecting head used in the manufacture of electrode structures such as those of an organic electroluminescence (EL) display, a field effect display (FED), or a bioorganic matter ejecting head used in the manufacture of biochips or the like. In the color material ejecting head for a display manufacturing apparatus, a solution of each color material of red (R), green (G), and blue (B) is ejected as a kind of liquid. In addition, in the electrode material ejecting head for an electrode forming apparatus, a liquid electrode material is ejected as one kind of liquid, and in the bioorganic matter ejecting head for a chip manufacturing apparatus, a solution of bioorganic matter is ejected as a kind of liquid.

The entire disclosure of Japanese Patent Application No. 2017-104230, filed May 26, 2017 and 2017-147581, filed Jul. 31, 2017 are expressly incorporated by reference herein.

What is claimed is:

1. A nozzle plate comprising:

a nozzle from which a liquid is ejected and that has an opening at one surface side of the nozzle plate; and a liquid repelling layer containing a cross-linked fluororesin and formed on the one surface side of the nozzle plate; and a protective layer that is formed on the one surface side and that protects against the liquid, on the protective layer the liquid repelling layer being stacked, wherein a top of the protective layer at a first position is lower than a top of the protective layer at a second position, the second position being farther than the first position from the nozzle, and wherein a top of the liquid repelling layer at the first position is substantially equal to a top of the liquid repelling layer at the second position.

2. The nozzle plate according to claim 1, wherein the liquid repelling layer is cross-linked with the one surface side.

3. The nozzle plate according to claim 1, wherein the protective layer has conductivity.

4. The nozzle plate according to claim 1, wherein the nozzle has a first portion including the opening and a second portion communicating with the first portion, the diameter of the opening of the first portion is larger than the diameter of the second portion, and the liquid repelling layer is formed on the first portion.

5. The nozzle plate according to claim 4, wherein
the first portion is formed in a shape in which an edge corner of the opening is cut out.

6. The nozzle plate according to claim 4, wherein
the first portion is formed in a shape in which an edge corner of the opening is chamfered diagonally.

7. The nozzle plate according to claim 4, wherein
the first portion is formed in a shape in which an edge corner of the opening is rounded.

8. A liquid ejecting head comprising:
the nozzle plate according to claim 1.

9. A liquid ejecting apparatus comprising:
the liquid ejecting head according to claim 8.

10. A method of manufacturing a nozzle plate in which a liquid repelling layer containing a cross-linked fluororesin is formed on one surface side where a nozzle from which a liquid is ejected opens, the method comprising:
stacking a non-cross-linked-fluororesin-containing layer in which a non-cross-linked-fluororesin-containing layer, which contains a non-cross-linked fluororesin prior to cross-linking, is stacked on the one surface side, and
cross-linking the non-cross-linked-fluororesin-containing layer and forming the liquid repelling layer by irradiating at least one of α ray, β ray, γ ray, X ray, or electron beam to the non-cross-linked-fluororesin-containing layer with heat in a low oxygen atmosphere having an oxygen concentration.

11. The method of manufacturing a nozzle plate according to claim 10 further comprising:
removal in which at least a portion of the liquid repelling layer formed in the nozzle is removed.

12. The method of manufacturing a nozzle plate according to claim 11, wherein
in the removal, at least a portion of the liquid repelling layer formed in the nozzle is removed by performing irradiation with an ion beam or radiation from the one surface side in a state where a mask having a through hole formed at a position corresponding to the nozzle is superimposed on the liquid repelling layer from the one surface side.

13. The method of manufacturing a nozzle plate according to claim 11, wherein
in the removal, at least a portion of the liquid repelling layer formed in the nozzle is removed by performing irradiation with an ion beam or radiation from the side opposite to the one surface side.

14. The method of manufacturing a nozzle plate according to claim 10 further comprising:
polishing in which a surface of the liquid repelling layer is polished after the cross-linking.

15. The method of manufacturing a nozzle plate according to claim 10, wherein
the stacking of the non-cross-linked-fluororesin-containing layer includes dispersion coating in which a dispersion, which contains particles of the non-cross-linked-fluororesin and a dispersion medium in which the particles of the non-cross-linked fluororesin are dispersed, is applied on the one surface side and drying in which the dispersion medium is evaporated from the dispersion applied on the one surface side.

16. The method of manufacturing a nozzle plate according to claim 15, wherein
the average particle diameter of the non-cross-linked fluororesin contained in the dispersion is not more than half of the film thickness of the liquid repelling layer formed on the one surface side.

17. The method of manufacturing a nozzle plate according to claim 10, wherein
the stacking of the non-cross-linked-fluororesin-containing layer includes sheet arranging in which a resin sheet containing the non-cross-linked fluororesin is brought into close contact with the one surface.

18. The method of manufacturing a nozzle plate according to claim 10, wherein
in the cross-linking, the non-cross-linked fluororesin is cross-linked while suction is performed through the nozzle.

19. The method of manufacturing a nozzle plate according to claim 10, wherein
the stacking of the non-cross-linked-fluororesin-containing layer and the cross-linking are alternately repeated at least two or more times.

20. The nozzle plate according to claim 1, wherein
the protective layer includes tantalum nitride.

* * * * *